US005541975A

United States Patent [19]

Anderson et al.

[11] Patent Number: 5,541,975

[45] Date of Patent: Jul. 30, 1996

[54] X-RAY TUBE HAVING ROTARY ANODE COOLED WITH HIGH THERMAL CONDUCTIVITY FLUID

[76] Inventors: Weston A. Anderson, 763 LaPara Ave., Palo Alto, Calif. 94306; James T. Arnold, 778 Blanchard Way, Sunnyvale, Calif. 94087; Gordon R. Lavering, 4111 Skymont Dr., Belmont, Calif. 94002; Jack J. Duffield, 878 Helena Dr., Sunnyvale, Calif. 94087

[21] Appl. No.: 179,023

[22] Filed: Jan. 7, 1994

[51] Int. Cl.[6] ..... H01J 35/10

[52] U.S. Cl. ..... 378/130; 378/133; 378/200

[58] Field of Search ..... 378/119, 130, 378/131, 133, 141, 144, 199, 200, 202, 132; 313/362.1

[56] References Cited

U.S. PATENT DOCUMENTS

| | | | |
|---|---|---|---|
| H,312 | 7/1987 | Parker | 378/130 |
| 3,694,685 | 9/1972 | Houston | 313/60 |
| 4,146,815 | 3/1979 | Childeric | 378/130 |
| 4,210,371 | 7/1980 | Gerkema et al. . | |
| 4,625,324 | 11/1986 | Blaskis et al. | 378/130 |
| 4,641,332 | 2/1987 | Gerkema | 378/125 |
| 4,644,577 | 2/1987 | Gerkema et al. | 378/133 |
| 4,677,651 | 6/1987 | Hartl et al. | 378/133 |
| 4,856,039 | 8/1989 | Roelandse et al. | 378/133 |
| 5,224,142 | 6/1993 | Ono et al. | 378/128 |

FOREIGN PATENT DOCUMENTS

| | | | |
|---|---|---|---|
| 3644 | 3/1988 | Germany | H01J 35/10 |
| 62-122033 | 11/1987 | Japan | H01J 35/10 |

*Primary Examiner*—David P. Porta
*Assistant Examiner*—Don Wong
*Attorney, Agent, or Firm*—Edward H. Berkowitz; Bella Fishman; David J. Power

[57] ABSTRACT

An X-ray tube rotating anode is cooled with a liquid metal functioning as a recirculated heat exchange fluid and/or a metal film in a gap between the anode and a stationary structure. The liquid metal is confined to the gap by (a) a labyrinth having a coating that is not wetted by the liquid, (b) a magnetic structure, or (c) a wick. The liquid metal recirculated through the anode is cooled in a heat exchanger located either outside the tube or in the tube so it is surrounded by the anode. The heat exchanger in the tube includes a mass of metal in thermal contact with the recirculating liquid metal and including numerous passages for a cooling fluid, e.g. water. A high thermal conductivity path is provided between an anode region bombarded by electrons and a central region of the tube where heat is extracted. In one embodiment the high thermal conductivity is achieved by stacked pyrolytic structures having crystalline axes arranged so there is high heat conductivity radially of the region and lower thermal heat conductivity normal to the high heat conductivity direction.

124 Claims, 13 Drawing Sheets

X-RAY TUBE HAVING ROTARY ANODE COOLED WITH HIGH THERMAL CONDUCTIVITY FLUID

FIELD OF INVENTION

The present invention relates generally to vacuum tubes having rotating anodes bombarded by energetic electrons and, more particularly, to such a vacuum tube including a liquid metal to assist in removing heat from such an anode.

BACKGROUND ART

Vacuum tubes including rotating anodes bombarded by energetic electrons are well developed and extensively used, particularly as X-ray tubes wherein the anode includes a rotating X-ray emitting track, usually made of tungsten, bombarded by electrons from a cathode. X-rays emitted from the track are transmitted through a window in a tube envelope. The anode is rotated so at any instant only a small portion thereof is bombarded by the electrons. Even though the energetic electrons are distributed over a relatively large surface area, anodes of high power tubes of this type frequently are heated sufficiently to become incandescent in response to the bombardment.

One previous technique advanced to assist in cooling such an anode is the placement of a relatively high thermal conductivity liquid metal film in the thermal pathway between the rotating anode and a stationary heat removing structure. The liquid metal is usually gallium or a gallium alloy; gallium is used because it has a sufficiently low vapor pressure to be compatible with the low pressures within the vacuum tube envelope. Nearly all of the gallium remains in liquid form from 30° C. to several hundred degrees centigrade. Gallium melts at a temperature of 29.78° C. Certain gallium alloys, specifically binary and ternary eutectics, are frequently used because they melt at lower temperatures, near the melting temperature of water ice.

German Patent Publication DE 3644719 C1 discloses an X-ray tube including a rotating anode track irradiated by electrons from a cathode. A liquid metal, preferably a gallium alloy, film fills a gap between a stationary structure and a back face of the anode, opposite from the track. A cooling fluid, preferably water, is supplied to a cavity behind a wall of the stationary structure. The cooling fluid is thereby in a high thermal conductivity path with the track by way of the wall and liquid metal film.

Houston, U.S. Pat. No. 3,694,685, discloses an X-ray tube having a rotating anode mechanically connected by a high thermal conductivity rotating structure to a gap in a central region of the tube; the gap is filled with a liquid metal film. The gap is between a wall of the rotating structure and a stationary wall of a structure having a cooling fluid, preferably water, flowing through it.

Japanese patent publication 87-194011/28 discloses an X-ray tube having a rotating anode cooled by a vaporizable oil stored in a pool at the bottom of the tube. The oil is pumped as a liquid from the pool so it flows along a back wall of the anode, opposite from the wall containing the X-ray target. The oil is vaporized by heat from the target and then vapor is directed back to the pool. A vacuum pump is connected to the evacuated space to maintain a sufficiently low pressure within the tube.

While the structures of the Houston, German and Japanese references have been suggested, there has been, to our knowledge, no commercialization of the cooling structures disclosed in these patents. For many applications, the structures of these prior art references do not appear to provide adequate cooling of the rotating anode to make investment in use of the liquid metal worthwhile. The corrosive nature of gallium and alloys thereof requires very resistant materials, such as molybdenum, to contact the gallium or gallium alloy. Further, there is no structure disclosed in the German reference or in Houston for adequate confinement of the gallium to the gap between the rotating and stationary parts. In a practical device, gallium and its alloys must be confined because of the highly corrosive properties thereof and because gallium, which in an electrical conductor, may cause electrical shorts in other parts of the tube. In the Japanese reference, the vapor is free to flow over an interior wall of a vacuum envelope including the anode and a cathode.

A number of patents have been issued to Philips relating to an anode disc rotatably journalled on one or more helical-groove bearings. These include the following U.S. Pat. Nos. 4,210,371; 4,375,555; 4,614,445; 4,641,332; 4,644,577; 4,677,651 and 4,856,039 all assigned to US Philips Corporation. It is claimed that X-ray tubes utilizing such bearings have quieter operation and longer life. They have also found that these tubes can operate at higher power levels as more heat is conducted through these bearings than is conducted by ball bearings. These patents do not show or describe ways of providing a high conductivity heat path from the anode track, through a liquid metal film, and then to a high capacity heat exchanger nor do they provide a labyrinth for containing the liquid metal.

It is, therefore, an object of the present invention to provide a new and improved vacuum tube having a rotating anode track bombarded by energetic electrons and cooled with the aid of a liquid metal.

Another object of the invention is to provide a new and improved vacuum tube of the aforementioned type wherein a liquid metal is recirculated through the anode and a heat exchanger to provide considerably greater cooling effects than have been achieved in the prior art.

A further object of the invention is to provide a new and improved vacuum tube of the aforementioned type having improved thermal conducting structures for removing heat from a rotating anode track bombarded by energetic electrons.

Another object of the invention is to provide a new and improved vacuum tube of the aforementioned type wherein a liquid metal film is confined to a gap between a rotating anode region and a stationary wall in the tube.

SUMMARY OF THE INVENTION

The invention in general is directed to a vacuum tube comprising a vacuum chamber including an electron emitter, a rotatable anode having a track responsive to the electrons, and improved means for cooling the anode region. The improved cooling means includes a heat exchange liquid metal having sufficiently low vapor pressure at the operating temperature and chamber pressure so the liquid does not substantially vaporize while the tube is operating.

In accordance with the invention, improved cooling means are provided in a rotating anode X-ray tube without requiring rotating vacuum seals. In many prior art rotating anode X-ray tubes, anode cooling has been obtained through the use of rotating vacuum seals. In these tubes, coolant from an external source is fed through a rotating vacuum seal into channels within the anode to receive heat from the anode track. The coolant is then fed back through the same or a second rotating seal to an external cooler before it is recirculated.

Rotating seals, such as those incorporating ferrofluid liquids, have slow leak rates at the operating speeds of rotating anode X-ray tubes, so a vacuum pump is required to obtain a sufficient vacuum for X-ray tube operation. In addition to making the system more complex, a vacuum pump is highly undesirable with certain applications, such as X-ray tubes used in CT scanners where the X-ray tube is located in a rotating gantry. In accordance with the present invention, the vacuum chamber is completely enclosed with no rotating or sliding seals between a vacuum enclosure and outside space.

In accordance with one aspect of the invention the improved cooling means includes a stationary heat exchanger for liquid metal flowing in a recirculating flow path through the anode in proximity to the track. The liquid metal flow path is confined between opposing wall segments extending in the principal direction of flow of the liquid metal the entire time while the liquid metal is being recirculated in the vacuum chamber. Thereby, the corrosive effects of the liquid metal are minimized by limiting the liquid metal flow to a very precise path having surfaces that can be protected with suitable materials.

Preferably the recirculating flow path is arranged and has a geometry so the liquid is "self" pumped in the path in response to forces applied to the liquid by the combination of (1) heat transferred from the anode to the liquid thereby changing its density, and (2) the centrifugal force due rotation of the anode by the rotor. The liquid metal is heated by conduction in the vicinity of the track so its density is changed. Relatively low density heated liquid metal flows from the track vicinity toward the axis and higher density liquid metal that has been cooled in the heat exchanger flows away from the axis toward the track. Such convective "self" pumping avoids the need for external pumps and the like for the recirculating liquid metal.

In accordance with an additional aspect of the invention, the improved cooling means includes a heat exchanger having a stationary solid high thermal conductivity material in a high thermal conductivity path with a liquid metal or other suitable heat conducting fluid. The solid heat exchange material includes passages to provide a large contact area to the flowing cooling fluid. In one embodiment the solid material comprises a porous metal mass having pores forming the passages for the cooling fluid. In one arrangement the porous metal mass comprises bonded metal particles while in a second arrangement the porous metal mass comprises a bundle of metal wires extending in generally the same direction as the fluid flow. Spaces between the wires provide paths through which the cooling fluid can flow. In a second embodiment, the solid material comprises plural plate like structures generally at right angles to the fluid flow through the heat exchanger. The plate-like structures provides a large area contacting surface with the cooling fluid, and numerous holes allow passage of the cooling fluid through the solid material. The holes have a small area relative to the area of the plate structure.

In accordance with a further aspect of the invention wherein the heat exchange liquid metal is in thermal conduction contact with the rotatable anode region and a stationary portion of the tube, a labyrinth between a first wall of a rotatable structure and a second stationary wall prevents flow of the corrosive liquid metal through it. The labyrinth preferably includes one or more grooves forming a tortuous path for the liquid metal; the grooves have a gap typically in the range of 0.001 to 0.01 inches. The labyrinth includes surfaces that are not wettable by the liquid metal to prevent the flow of the liquid through the labyrinth by creep or capillary action. In one embodiment, the liquid metal is a film in a gap between a stationary part of the tube and a rotating part of the anode. In another embodiment, the liquid is in a recirculating path having first and second walls respectively including a stationary part of the tube and a part of the tube that rotates with the anode track.

In accordance with another aspect of the invention, a heat exchange liquid film is in a gap between a surface of the rotatable anode and a facing stationary surface, wherein opposite ends of the gap are arranged to confine the liquid to the gap and prevent the liquid from flowing out of the gap. In one embodiment the film is confined by a labyrinth having surfaces that are not wettable by the liquid. In a second embodiment the liquid includes a ferrofluid, confined by magnet means at each end of the gap.

A further aspect of the invention is such that the cooling means includes a liquid film including a liquid metal in a gap between a rotating anode part and a stationary structure of the tube, wherein the liquid is stored in a wick.

An added aspect of the invention involves positioning the liquid film between a rotatable circumferential surface of the anode and a stationary circumferential surface and a structure for confining the liquid to a region between these circumferential surfaces while the anode is rotating and stationary. Hence, possible adverse effects of the liquid sloshing about the vacuum chamber are avoided.

In accordance with another aspect of the invention the improved cooling means is arranged so a liquid metal is a film within the gap between facing rotatable and stationary surfaces of the anode. The rotatable surface turns about an axis and the gap is (1) between a portion of the anode rotatable with the surface, (2) close to the axis and (3) elongated in the direction of the axis.

A further aspect of the invention provides an improved cooling means including a recirculating flow path for the liquid metal through the anode behind the electron bombarded track. The flow path includes first and second portions extending radially of an axis about which the track rotates and a third portion extending longitudinally of the axis in proximity to the axis relative to the track. Thereby, the liquid metal flows from the third portion into the first portion and from the second portion into the third portion. The liquid metal flows into (1) the first portion before passing the track and (2) the second portion after passing the track.

An additional aspect of the invention provides improved cooling means including a recirculating flow path for the liquid metal through the anode behind the electron bombarded track and through a heat exchanger. The recirculating path includes a mechanical pumping structure for assisting in liquid metal recirculation.

Another aspect of the invention provides an improved cooling means whereby the liquid metal flow path includes a recirculating flow path for the liquid metal through the anode behind the electron bombarded track, and first and second portions extending radially relative to the axis about which the track rotates. The path includes stationary third, fourth and fifth portions. The third portion carries the cooling fluid from the second portion along a path parallel to the axis of rotation to a region outside the vacuum chamber segment where the anode and cathode are located. The fourth portion of the path is through a heat exchanger where heat is conducted from the liquid metal to an external medium. The fifth portion carries cooled liquid metal from the heat exchanger back along a path parallel to the axis of the tube to said first path portion.

In accordance with a further aspect of the invention, the improved cooling means comprises an anode including a pyrolytic graphite structure connected and arranged in a thermal conduction path between the anode track and a liquid metal film; the film conducts the heat to a stationary heat exchanger. The pyrolytic graphite structure is preferably arranged as multiple stacked elements having their high thermal conductivity crystalline axes oriented to provide a high thermal conduction path between the anode track region and the heat exchanger. In one embodiment the structures are plates while in a second embodiment the structures are nested cones.

In a preferred configuration, the recirculating flow path through the anode includes a first portion arranged so the liquid metal flows radially from the vicinity of the axis about which the anode rotates toward the vicinity of the track and a second portion arranged so the liquid metal flows radially from the vicinity of the track back to the vicinity of the axis. Preferably, the heat exchanger is within the tube close to the axis and anode. In one embodiment, the anode is constructed with the flow path entirely contained within the rotating structure including a segment flowing parallel to the axis to thereby enhance liquid circulation that would be impeded by shear forces in the liquid if one of the facing walls were stationary and the other rotating.

The above and still further objects, features and advantages of the present invention will become apparent upon consideration of the following detailed description of several specific embodiments thereof, especially when taken in conjunction with the accompanying drawings.

DETAILED DESCRIPTION OF THE PREFERRED EMBODIMENTS

Figure 1:
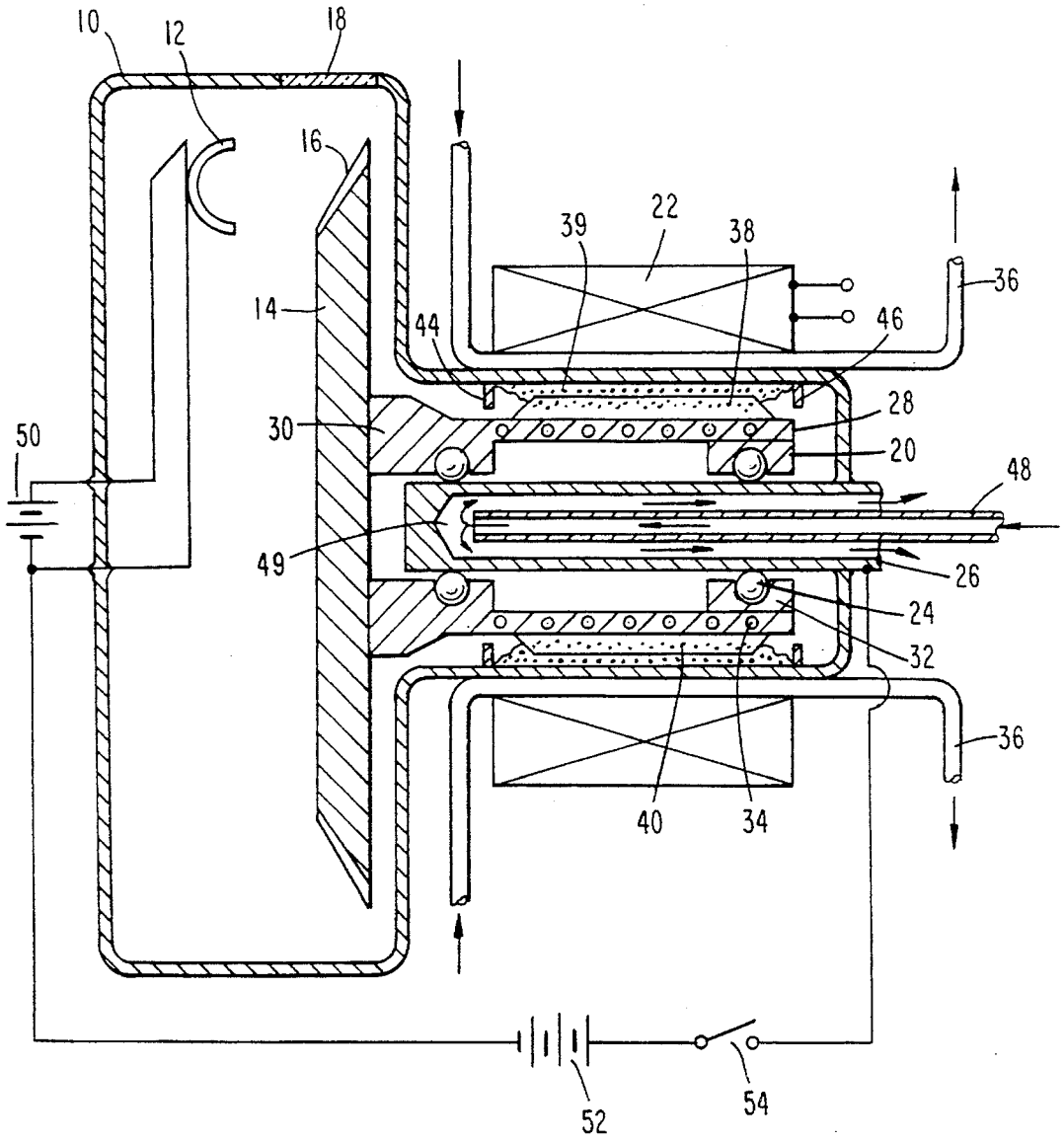
FIG. 1 is a schematic cross-sectional view of an X-ray tube incorporating a liquid metal film in a gap abutting a wick, wherein the liquid metal film is confined to the gap by a labyrinth including a surface that is not wettable by the liquid metal.

Reference is now made to FIG. 1 of the drawing wherein there is illustrated stationary vacuum envelope 10 comprising electron emitting cathode 12 and rotating anode 14 including a tapered edge containing X-ray emitting, tungsten track 16. Track 16 is positioned directly opposite cathode 12 and is arranged so X-rays emitted thereby propagate through window 18 on the wall of envelope 10. Anode 14 is rotated by a structure including rotor winding 34 and stator winding 22, respectively inside and outside envelope 10. Ball bearings 24 support rotor structure 20 on stationary tube 26, fixedly mounted on envelope 10. Rotor structure 20 includes tube 28, coaxial with tube 26 and including shell 30, fixedly connected to a face of anode 14 at right angles to the common axis for tubes 26 and 28. Ball bearings 24 are carried by flange 32 and shell 30, at opposite ends of tube 28 to provide lateral support for the tube and anode 14. Rotor winding 34, having an axis coincident with tubes 26 and 28, is embedded in the wall of tube 28 to interact with magnetic flux generated by stator winding 22 to drive rotor structure 20 about the axis of tube 26.

The periphery of envelope 10, in the region between windings 22 and 34, is cooled by cooling fluid (preferably water) that flows through multiple non-ferromagnetic cooling tubes 36 (only two of which are illustrated). Cooling tubes 36 are arranged so they extend completely around the periphery of envelope 10 in the region between windings 22 and 34, and in thermal contact with the wall of envelope 10. The cooling fluid flowing through tubes 36 removes heat generated within envelope 10 by track 16 being bombarded by electrons from cathode 12. To provide a high thermal conductance path between track 16 and the exterior of envelope 10 where cooling tubes 36 are located, despite the vacuum within envelope 10, wick 38, which can be wet by the liquid metal, is mounted on the exterior of tube 28, along the length of the tube, substantially throughout the region between windings 22 and 34.

Gap 39 is located between the longitudinally extending edge of wicking material 38 and the interior sidewall of envelope 10 in the region between windings 22 and 34. Gap 39 is filled with heat exchange liquid metal 40 having sufficiently low vapor pressure at the operating temperature of anode 14 so the liquid metal does yield excessive vapor pressure while the X-ray tube is operating. Preferably, heat exchange liquid metal 40 is gallium or a gallium alloy.

The interior wall of envelope 10 carries longitudinally spaced radially extending labyrinths 44 and 46, at opposite ends of gap 39 where liquid metal 40 is located. Labyrinths 44 and 46 are coated or made of a material that is not wetted by the heat exchange liquid metal 40; such materials are carbon and titanium oxide. Labyrinths 44 and 46 effectively prevent liquid metal 40 from flowing out of gap 39. Gap 39 typically have a spacing in the range of 0.001 to 0.01 inches.

The X-ray tube is also cooled by directly cooling the interior surface of tube 26. To this end, cooling fluid, preferably water, flows into pipe 48, fixedly mounted on envelope 10 so it is coaxial with and inside tube 26. The cooling fluid flows through pipe 48, thence into chamber 49, proximate to anode 14 between the interior wall of tube 26 and the end of pipe 48. From chamber 49, the cooling fluid flows longitudinally away from anode 14 back toward the same region where it originally entered pipe 48.

Operating power for cathode 12 and anode 14 is provided by DC power supplies 50 and 52, respectively. Power supply 50 provides current to heat cathode 12, while power supply 52 provides the necessary high voltage between cathode 12 and anode 14. Power supply 52 includes a negative electrode connected directly to cathode 12 via suitable lead lines. The positive terminal of power supply 52 is connected through switch 54 to anode 14 via connections through metal stationary tube 26 and the metal wall of envelope 10, thence via the liquid metal 40 to metal tube 28 and shell 30 to the anode; there is a parallel path from tube 26 through metal ball bearings 24 and metal flange 32 to tube 28 and shell 30. Envelope 10 and the liquid metal 40 are also maintained at the voltage of the positive electrode of DC power supply 52 (usually ground) to prevent arcing.

Prior to operation of the X-ray tube while anode 14 is stationary, the gallium or gallium alloy liquid metal 40 is stored in wick 38 so it is not susceptible to leakage to the remainder of the interior of X-ray tube envelope 10. Simultaneously with power being applied to stator winding 22, fluid flows in pipe 48 to tube 26 and in cooling tubes 36. In response to rotor structure 20 turning (typically at speeds in excess of 5,000 rpm) the liquid metal 40 stored in wick 38 moves outwardly from the wick toward and into contact with the interior wall of envelope 10 between windings 22 and 34. The liquid metal 40 is confined to the region between tubes 36 and tube 28 by non-wettable labyrinths 44 and 46. A high thermal conductance path is thereby provided between anode 14 and the cooling fluid flowing in tubes 36. The liquid metal transfers heat by conduction from tube 28 to cooling tubes 36.

When switch 54 is closed and electrons from cathode 12 are accelerated to track 16 of anode 14, heat produced by the electron bombardment of track 16 is removed through the stated path. Additional heat is removed by the thermal conduction path from anode 14 through shell 30 and tube 28, thence through ball bearings 24 to tube 26 and the fluid flowing through tube 26.

Figure 2:
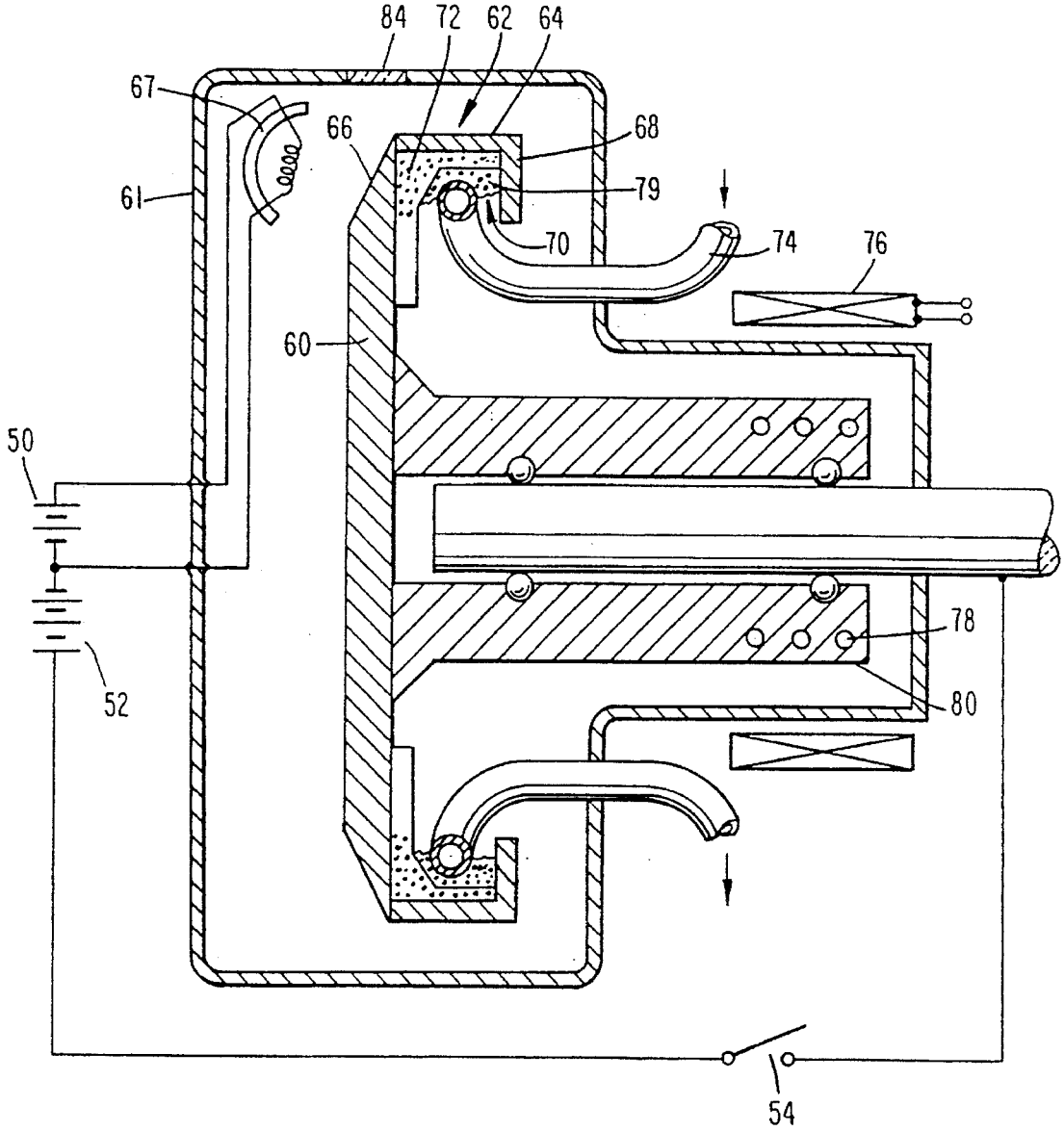
FIG. 2 is a schematic cross-sectional view of another embodiment of an X-ray tube including a liquid metal film in a gap between a wick on a rotating anode immediately behind an electron bombarded track.

FIG. 2 is a schematic, cross-sectional view of another embodiment of an X-ray tube wherein the thermal conductivity path from the anode to the heat exchange structure is shorter than that illustrated in FIG. 1. Hence, the thermal conductivity of the structure illustrated in FIG. 2 is greater than that of the structure illustrated in FIG. 1. In the embodiment of FIG. 2, anode 60 in vacuum envelope 61 includes rim 62 including axially extending rotating ring 64, attached to the periphery of anode 60, immediately behind track 66 where electrons from cathode 67 are incident. Rim 62 includes flange 68 that extends radially inwardly from ring 64. Enclosed region 70 is thereby formed behind track 66, ring 64 and flange 68. Wick 72 fills a substantial portion of enclosed or confined region 70, by being deposited along the back face of anode 60, i.e., the face of the anode opposite from track 66. Wick 72 extends along the back face of anode 60 to ring 64 and may continue along the interior wall of ring 64 to the facing wall of flange 68 and may continue further along the inside of flange 68. Wick 72 stores a heat exchange liquid metal, of the type mentioned supra.

Tube 74 is located in enclosed volume 70, in close proximity to, but slightly spaced from, wick 72. In a cross-section at right angles to the cross-section illustrated in FIG. 2, tube 74 has a circular configuration. Cooling fluid, preferably water, flows through tube 74. Other tube shapes may be used to provide a narrower gap 79 between the rotating and stationary members.

In operation, when anode 60 is rotated at high speed by a motor structure including stator winding 76 and rotor winding 78 in sleeve 80, fixedly attached to anode 60, the heat exchange liquid metal in wick 72 is drawn out of that part of the wick nearer the rotational axis by centrifugal force and migrates into gap 79. A high thermal conductance path is thereby established between track 66 of anode 60 and the cooling fluid flowing through tube 74. The high thermal conductance is provided because of the short distance between track 66 and the liquid flowing in tube 74. When anode 60 stops rotating, capillary action causes the liquid metal to return to the wick, thereby confining the liquid metal and preventing it from migrating to cathode 67, anode track 66 and other parts of the X-ray tube.

Energizing power is supplied to the cathode and anode of the X-ray tube by DC power supplies 50, 52 and switch 54 in the manner described in connection with FIG. 1 for the corresponding electrodes. In response to electron bombardment by cathode 67 of track 66 of anode 60, X-rays are emitted from the track and propagate through window 84 in the same manner that X-rays propagate through the corresponding window in FIG. 1.

Figure 3:
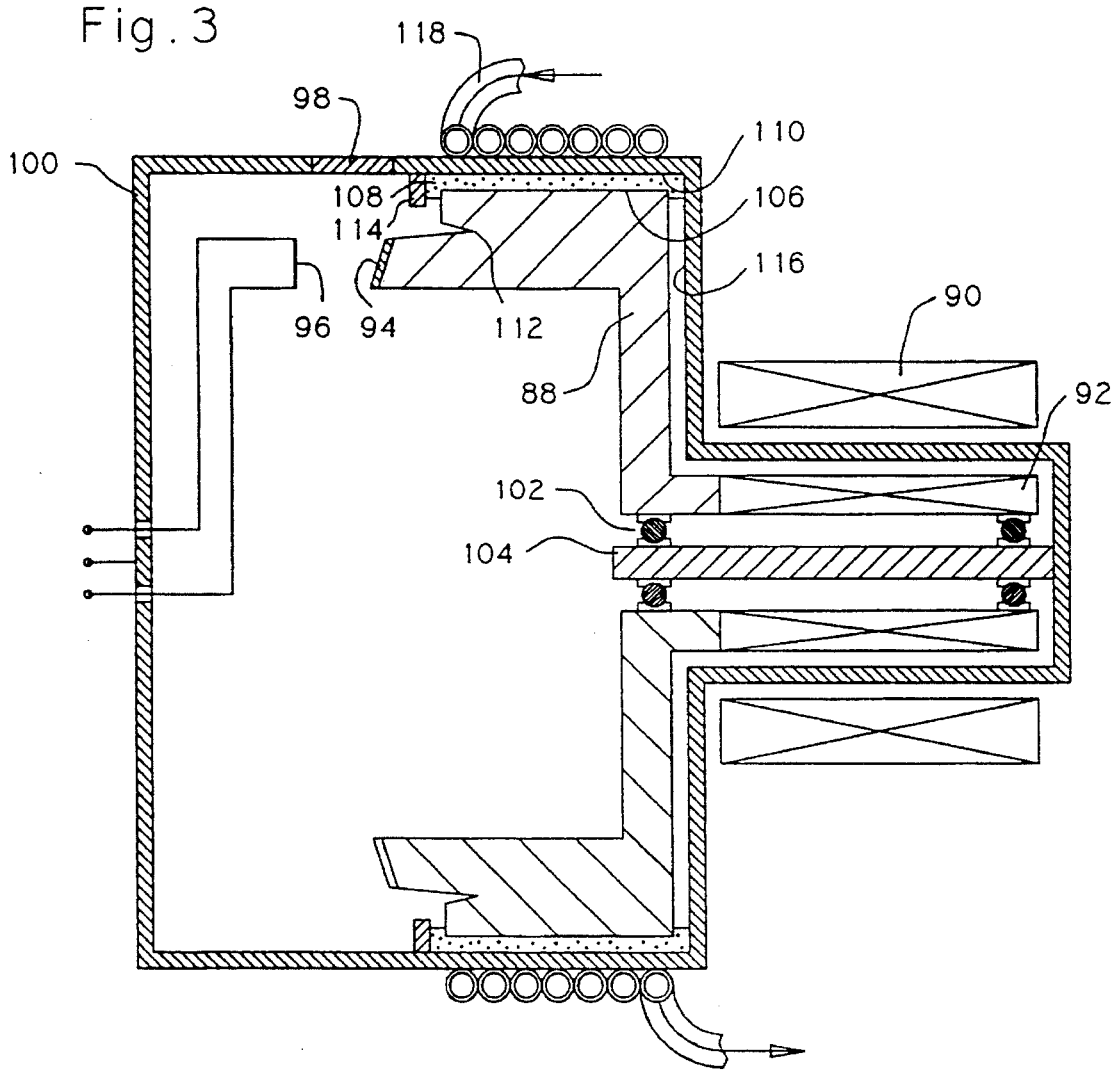
FIG. 3 is a schematic cross-sectional view of a further embodiment of an X-ray tube including a liquid heat transfer film between a wall of the rotating anode and a wall of the X-ray tube envelope.

Reference is now made to FIG. 3 of the drawing, another embodiment of the invention wherein rotating anode 88, driven by stator winding 90, and including rotor winding 92, contains X-ray emitting track 94, responsive to electrons from cathode 96. X-rays emitted by track 94 propagate through window 98 in stationary, grounded metal vacuum envelope 100. Metal bearings 102 support rotating anode 88 on rod 104, fixedly mounted on the longitudinal axis of envelope 100.

Anode 88 includes cylindrical wall 106, fixedly spaced by a relatively small gap 108 from cylindrical interior wall segment 110 of envelope 100. To provide a more even temperature distribution along the length of gap 108, anode 88 includes cusp 112, which forms a trough between track 94 and gap 108. Gap 108 is filled with a liquid metal, preferably gallium or an alloy thereof; alternatively, as described in connection with FIG. 4, a ferrofluid can fill gap 108. The liquid metal is confined to gap 108 by flange 114, extending radially inward from the exterior wall of envelope 100, as well as by the interior wall of the envelope defining the outer surface of the gap and a radially extending segment 116 of envelope 100. Flange 114 is coated with a material that is not wetted by the liquid metal in gap 108 to confine the liquid metal to the gap. The portions of envelope 100 in contact with gallium or the gallium alloy liquid metal in gap 108, as well as the cylindrical surface 106 of anode 88, are preferably coated with a tough metal, such as molybdenum, capable of withstanding the corrosive effects of gallium and its alloys.

The outer wall of envelope 100 opposite from interior wall segment 110 is cooled by a heat exchange fluid, preferably water, flowing through cooling tube 118, configured as a helix, i.e. coil, abutting the exterior wall of envelope 100 in the stated region. During operation of the X-ray tube, the cooling fluid continuously flows through tube 118, to remove heat transferred from track 94 to surface 106 via the high thermal conductance path established between surface 106 and wall segment 110 by the high thermal conductivity liquid metal in gap 108.

Figure 4:
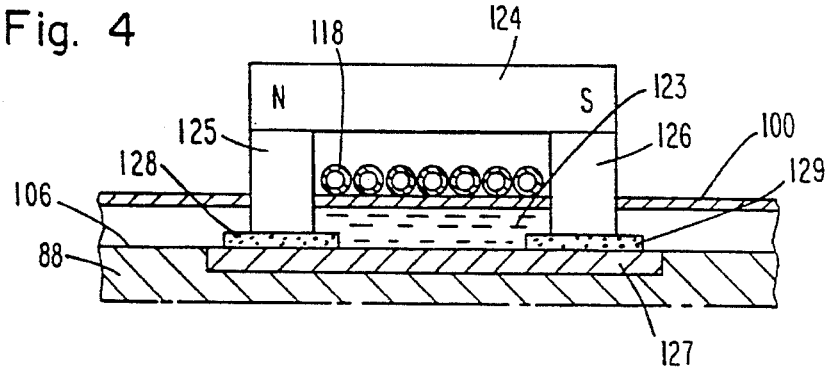
FIG. 4 is a schematic cross-sectional view of a portion of one embodiment of a structure of the type illustrated in FIG. 3, wherein the liquid heat transfer film is confined by a ferrofluid constrained by a permanent magnet.

In the embodiment of FIG. 4, the gallium or gallium alloy film in the embodiment of FIG. 3 is replaced by high thermal conductivity ferrofluid 129, an oil having a colloidal suspension of iron particles therein; ferrofluids are not therefore considered to be liquid metals. Ferrofluid 129 fills gap 108 and is held in situ by magnetic flux from ring magnet 124 having north and south poles (N and S), spaced from each other in the axial direction of the X-ray tube. Magnet 124 is spaced from the outer wall of envelope 100 and is positioned so tube 118 fits between the interior wall of the ring magnet and the exterior wall of envelope 100. Annular pole pieces 125 and 126 respectively abut against the north and south pole faces of ring magnet 124 and extend through the non-magnetic metal of envelope 100 into contact with the ferrofluid in gaps 128 and 129. A return magnetic flux path is provided by ferromagnetic cylinder 127 fixed to anode 88. High thermal conductivity ferrofluid in gaps 128 and 129 and in region 123 between annular pieces 125 and 126 assists in transferring heat from surface 106 to the fluid flowing in coil 118. The high magnetic field strength in gaps 128 and 129 confines the ferrofluid, preventing it from escaping into other regions of the X-ray tube. The ferrofluid in region 123 can be replaced by a liquid metal.

While magnet 124 is preferably configured as a permanent magnet, it is to be understood that the same function can be provided by an electromagnet. The ferrofluid and magnetic structure of FIG. 4 can be used in configurations other than that illustrated in connection with FIG. 3, as long as the magnetic structure does not establish a magnetic field having a substantial influence on the trajectory of electrons from cathode 96 to anode track 94 or other magnetic circuits in the X-ray tube. A combination of a ferrofluid seal and liquid metal is achieved by placing the liquid metal in region 123 while the ferrofluid in gaps 128 and 129 forms a seal preventing the liquid metal from flowing into other regions of the X-ray tube.

Suitable DC power supplies are provided and connected to anode 88 and cathode 96 in the same manner described supra in connection with FIGS. 1 and 2.

Figure 5:
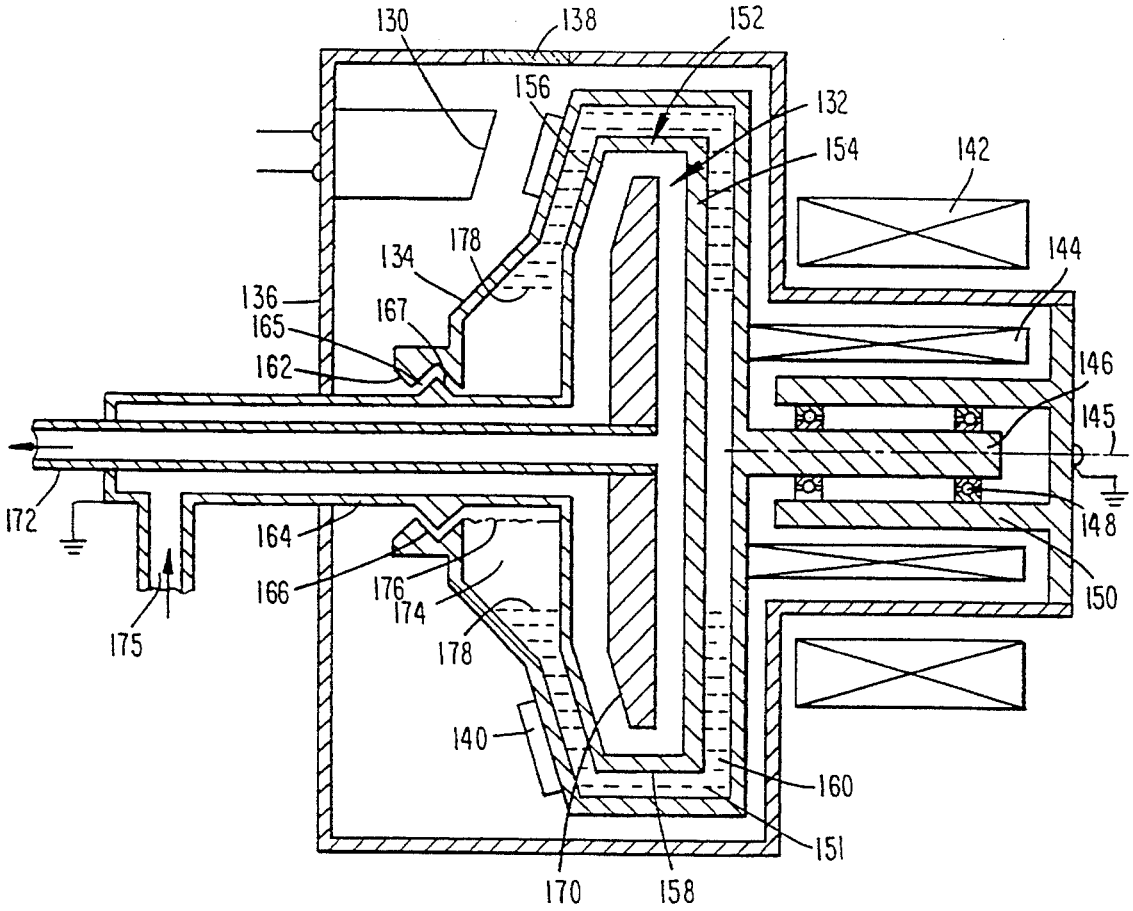
FIG. 5 is a schematic cross-sectional view of an additional embodiment of an X-ray tube having a labyrinth with non-wettable surfaces between rotating and stationary parts.

Reference is now made to FIG. 5 of the drawing, a further embodiment of the invention wherein cathode 130 and anode 132, including rotating anode segment 134, are located in vacuum envelope 136, including X-ray transparent window 138. Rotating segment 134 includes ring-shaped X-ray emitting track 140, positioned to be responsive to electrons from cathode 130; the X-rays derived from track 140 propagate through window 138.

Rotating anode segment 134 is turned by a motor structure including external stator winding 142 and internal rotor winding 144, mounted on the rotating anode segment. Windings 142 and 144 are coaxial with longitudinal rotational axis 145 of rotating anode segment 134. Rotating anode segment 134 includes axially extending shaft 146, having a longitudinal axis coincident with axis 145. Shaft 146 is supported by bearings 148 which are mounted in sleeve 150, attached to envelope 136 to be coaxial with axis 145.

Metal envelope 136 and anode 132, including rotating anode segment 134, are maintained at ground potential while cathode 130 is maintained at a high negative DC voltage for energization purposes. Rotating anode segment 134 is at the same potential as envelope 136 because of the low impedance electrical path established from the envelope through sleeve 150, bearings 148 and shaft 146 to the rotating segment. In addition, liquid metal 151 in anode 132 between rotating anode segment 134 and stationary shell 152 of anode 132 provides a low electrical impedance from the envelope to rotating anode track 140 to prevent arcing in bearings 148.

Nested within rotating anode segment 134 is metal, stationary shell 152 including metal end disc 154 and metal annular plate 156, both of which extend radially with respect to axis 145. The peripheries of disc 154 and plate 156 are connected together by axially extending metal ring 158. Thereby, enclosed gap 160 is formed between the walls of rotating anode segment 134 and shell 152; a significant portion of the gap is filled with confined liquid metal 151, preferably gallium or a gallium alloy. To prevent the flow of liquid metal 151 from gap 160, labyrinth 162 (having walls 166 and 167 coated with a material that is non-wettable by the gallium or gallium alloy) is located between stationary metal tube 164 and rotating anode segment 134. Tube 164 is fixedly mounted to shell 152 and to the metal wall of envelope 136. Labyrinth 162 is constructed so the transverse distance of gap 165 thereof between walls 166 and 167 of the labyrinth is considerably smaller than the longitudinal distance (length) of the gap. This gap relationship and the use of a non-gallium wettable surface on walls 166 and 167 prevent liquid metal from flowing through labyrinth 162.

Heat from the liquid metal in gap 160 is removed by circulating a cooling fluid (preferably water) into contact with stationary disc 154, plate 156 and ring 158. To this end, core 170, configured as a radially extending plate, is fixedly mounted inside shell 152. Core 170 is fixedly mounted on an open end of pipe 172 that extends through tube 164 and is mounted to an end wall of tube 164 outside of vacuum envelope 136. Water flows into tube 164 through port 175; thence, the water flows through tube 164 to core 170. From core 170, the water flows radially along plate 156, then along ring 158 and disc 154 to remove heat from heat conducting liquid metal 151 in gap 160. From the interior of shell 152, the now-heated water flows axially through pipe 172.

When rotating anode segment 134 is stationary, liquid metal 151 has a tendency to pool in the lower portion of gap 160. To provide sufficient volume for the pooled liquid metal below the level of walls 166 and 167 of labyrinth 162, gap 160 includes an enlarged volume 174 in proximity to and slightly below the entrance to labyrinth 162 from gap 160, as indicated by dotted line 176. When rotating anode segment 134 is rotated at normal operating speed in response to the motor action between windings 142 and 144, liquid metal 151 is pushed radially outward by centrifugal force, to the position indicated by dotted lines 178 to provide a short, high thermal conductance path between irradiated anode track 140 and metal shell 152. After the liquid metal has assumed the position indicated by dotted lines 178, a DC power supply (not shown in FIG. 5) is connected between envelope 136 and cathode 130. Current flows from the envelope to rotating anode segment 134 by way of liquid metal 151 in gap 160 to prevent arcing between all grounded parts and provide a very low electric impedance between the various grounded parts.

In each of the embodiments of FIGS. 1–5 a heat conducting ferrofluid or liquid metal film is provided between a rotating anode segment and the remainder of the anode. The film basically provides a high thermal conduction path from the rotating segment that is heated by electron bombardment. A heat exchange fluid helps to remove heat from the film in each of these embodiments. In other embodiments of the invention (described infra), a liquid metal is recirculated and cooled in a heat exchanger to provide more efficient cooling than is attained with the embodiments of FIGS. 1–5. In some of the additional embodiments, the liquid metal is recirculated.

Figure 6:
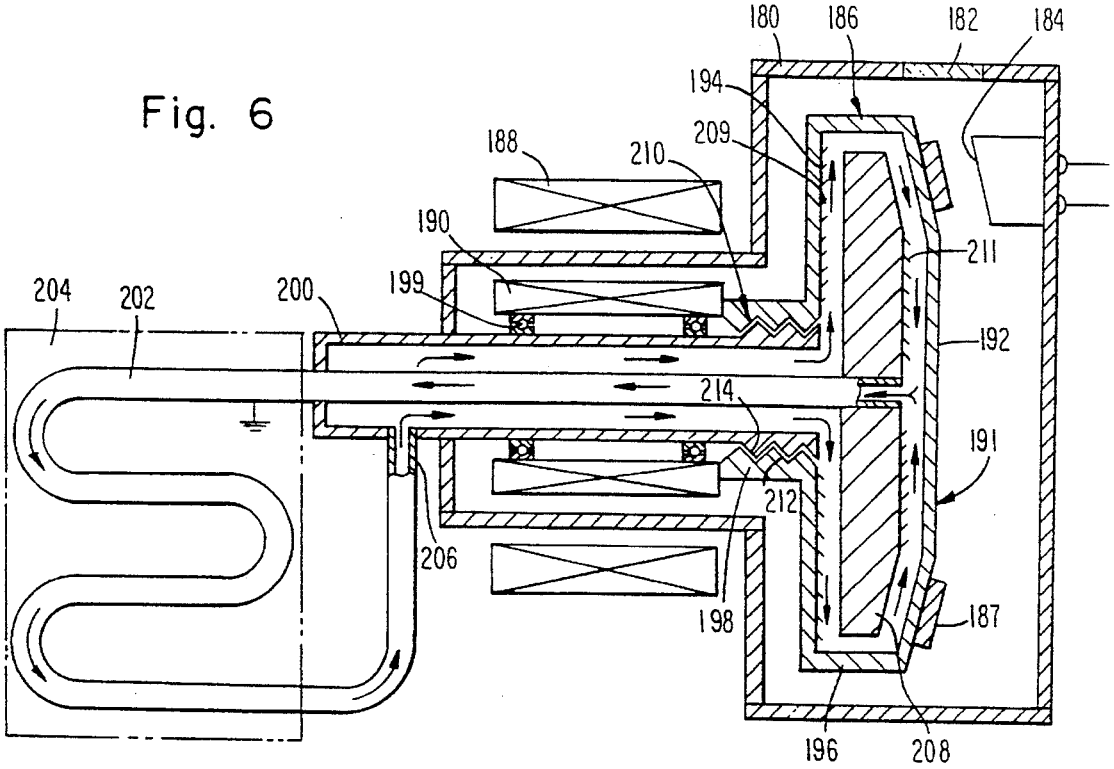
FIG. 6 is a schematic cross-sectional view of another embodiment of an X-ray tube including a liquid metal circulated through a rotating anode to a heat exchanger outside the X-ray tube envelope.

FIG. 6 is a schematic side view of an X-ray tube including a recirculating, confined liquid metal, e.g. gallium or alloys thereof, for removing heat from the rotating anode. The X-ray tube of FIG. 6 includes vacuum envelope 180 having therein window 182, cathode 184 and rotating anode 186. Anode 186 including electron bombarded X-ray emitting track 187, is rotated by a motor structure including stator winding 188 outside envelope 180 and rotor winding 190 within the envelope. Rotating anode 186 is configured as a shell including end plate 192, disc 194 and ring 196, having opposite edges fixedly connected to the plate and disc. The inner edge of disc 194 is fixedly connected to sleeve 198 on which rotor winding 190 is mounted. Winding 190 and sleeve 198 surround and are carried by bearings 199, in turn carried by stationary tube 200. The entire anode assembly, including shell 191 and sleeve 198, is coaxial with tube 200. The exterior wall of envelope 180 is affixed to tube 200; envelope 180, rotating anode 186 and tube 200 are at ground potential, while cathode 184 is at a high negative DC energizing voltage.

A liquid metal is recirculated in a confined manner within the interior of shell 191 so it cannot contact envelope 180, track 187, cathode 184 or any part of the motor structure. The liquid metal removes heat from walls 192 and 196 of shell 191. The liquid metal is recirculated at very low pressure via a path including pipe 202 that extends through heat exchanger 204. The pressure along the path for the liquid metal is substantially the same as in vacuum envelope 180, to obviate the need for a vacuum barrier between the liquid metal recirculation path and the vacuum chamber.

The liquid metal in pipe 202, after being cooled in heat exchanger 204, flows into tube 200 via orifice 206. Thence, the liquid metal flows axially into the interior of shell 191, where the liquid metal encounters stationary core 208, fixedly mounted on pipe 202 and configured as a radially extending plate. The liquid metal is pumped in a gap between the walls of core 208 and shell 191 by vanes 209 and 211. Vanes 209 are fixedly mounted on disc 194 while vanes 211 are on the face of core 208 facing plate 192. Vanes 209 are spirally mounted to enhance the pumping radially outwardly, while vanes 211 are spirally arranged to enhance pumping of the liquid metal radially inward toward the opening of pipe 202 on the wall of core 208 facing plate 192. Pumping of the liquid metal is also enhanced by the heating action of the liquid metal as it passes the portion of plate 192 opposite from the location of track 187. Thereby, the localized heating of track 187 by electrons from cathode 184 causes "self" pumping of the liquid metal in the gap between the walls of shell 191 and core 208.

Labyrinth 210, between sleeve 198 and tube 200, prevents the liquid metal from flowing between the sleeve and tube. Labyrinth 210 includes walls 212 and 214 respectively on sleeve 198 and tube 200; the labyrinth walls are very closely spaced to each other and are coated with a material that is not wetted by the liquid metal.

The liquid metal fills the gap between the interior walls of shell 191 and walls of core 208 to provide high thermal conductance and low electrical impedance between rotating anode 186 and the stationary metal parts in proximity thereto. Thereby, anode 186 is maintained at electrical ground potential, to minimize arcing, and is cooled by the high thermal conductivity and specific heat of the liquid metal circulating in contact with plate 192, disc 194 and ring 196.

In the structure of FIG. 6 substantial shear forces and turbulence are likely in the liquid metal flowing between the walls of shell 191 and core 208. Such forces and turbulence occur because of the very high differential speed between rotating shell 191 and stationary core 208 and the close proximity of these parts. These problems with the structure illustrated in FIG. 6 are overcome to a substantial extent by the structure illustrated in FIG. 7, which also provides additional advantages over the structure of FIG. 6.

Figure 7:
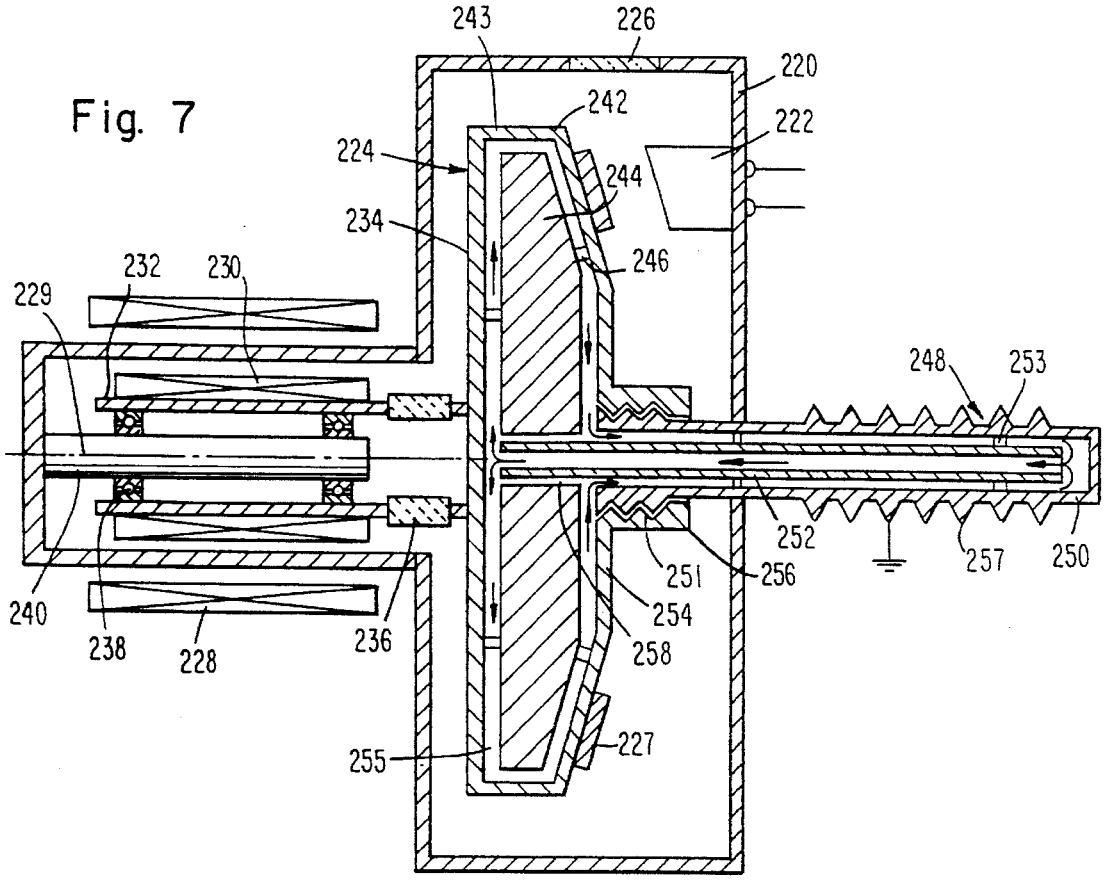
FIG. 7 is a schematic cross-sectional view of a further embodiment of an X-ray tube having a rotating anode through which a liquid metal flows between a shell and core that rotate together.

The X-ray tube of FIG. 7 includes vacuum envelope 220 in which are located cathode 222 and rotating anode 224 through which a confined liquid metal is recirculated for cooling purposes. In the wall of envelope 220 is X-ray transparent window 226, to allow passage of X-rays emitted from track 227 on anode 224 on which electrons from cathode 222 are incident. Anode 224 is rotated about central tube axis 229 by a motor structure including stator winding 228 and rotor winding 230. The rotor winding 230 is mounted on sleeve 232, which is fixedly connected to, and projecting from, disc 234 of anode 224. Preferably but not necessarily, sleeve 232 is connected to disc 234 by thermal and electrical insulating (preferably ceramic) ring 236 to decouple the motor structure electrically and thermally from anode 224; ring 236 can be replaced with a cylindrical block. Bearings 238, mounted on stationary rod 240, carry sleeve 232 and the entire rotating structure connected thereto.

Rotating anode 224 includes shell 242 and core 244, located within and fixedly connected to the shell by a plurality of struts 246. A liquid metal circulates past struts 246 in gap 255 between the interior walls of shell 242 and the outer walls of core 244. Because shell 242 and core 244 are mechanically connected to each other and thereby rotate together about axis 229 of the X-ray tube, the problems of shear force and turbulence which occur between shell 191 and core 208 in the structure of FIG. 6 are obviated.

The liquid metal is recirculated in gap 255 in a confined manner so it cannot contact envelope 220, target 227, cathode 222 or any part of the motor structure. The liquid metal is self-pumped between shell 242 and core 244. Self-pumping occurs because the liquid metal is heated principally in the anode region immediately behind track 227 on which electrons from cathode 222 are incident. The geometry of shell 242, core 244 and stationary heat exchanger 248 contributes to self-pumping of the liquid metal. To prevent flow of the liquid metal between the exterior wall of tube 252 and the facing, opposing cylindrical wall of core 244, these walls are closely spaced and coated with a material that is not wetted by the liquid metal. A small leakage here would not be detrimental to operation as it would only slightly reduce the cooling effects.

The structure of FIG. 6 can be modified so it is similar to FIG. 7 by connecting core 208 and shell 191 together and spacing the cylindrical wall of the core from the exterior wall of pipe 202. Vanes 209 and 211 are replaced by struts.

Heat exchanger 248 includes stationary exterior and interior tubes 250 and 252, both coaxial with the X-ray tube axis 229. Exterior tube 250, including heat exchange fins 257, is fixedly connected to the wall of envelope 220; interior tube 252 is fixedly connected by a plurality of struts 253 to exterior tube 250. Tube 250 extends through the wall of plate 254 of shell 242 into gap 255 between the shell 242 and core 244. Gap 255 extends radially between the facing walls of core 244 and the interior walls of shell 242 (i.e. the interior walls of disc 234, ring 243 and plate 254). The spacing between the interior walls of shell 242 and core 244, across gap 255, may be constant but is preferably narrowed in the region under the anode track 227 to provide improved heat transfer.

Plate 254 includes axially extending flange 256 that surrounds the end portion of exterior tube 250. Labyrinth 251, similar to labyrinth 210 of FIG. 6, is located between the exterior wall of tube 250 and the interior wall of flange 256 to prevent the flow of liquid metal from gap 255 between shell 242 and core 244 into the remaining volume within envelope 220.

Tube 252 protrudes through flange 256 and core 244 so an edge thereof is in a plane coincident with the wall of the core opposite from disc 234 to complete the recirculation path for the liquid metal. A small radius inlet for the liquid metal is provided from interior tube 252 into gap 255 between disc 234 and the opposite, facing wall of core 244. A large radius outlet for the liquid metal is provided from gap 255, in the region between plate 254 and the opposite facing wall of core 244 into tube 250, between the interior wall of tube 250 and the exterior wall of tube 252. Some pumping action occurs because of the centrifugal force given to the liquid metal as it enters the rotating anode shell at a small radius while the liquid exiting the shell does so at a larger radius. This is in addition to the self-pumping action described in FIG. 6 resulting from the localized heating of the liquid metal behind track 227 and cooling by the external heat exchange fins 257.

The liquid metal flows in a recirculating path, flowing in the interior of tube 252, from right to left (as viewed in FIG. 7). From tube 252, the liquid metal flows radially in the gap between disc 234 and core 244. The liquid metal, upon reaching the periphery of core 244, flows axially and thence radially inwardly behind heated track 227 to the opening between tubes 250 and 252. From the opening between tubes 250 and 252, the liquid metal flows axially in tube 250, between the inner surface thereof and the outer surface of tube 252, toward the right (as viewed in FIG. 7) where it is cooled by fins 257, and recirculated back down interior tube 252.

The structure of FIG. 7, like that of FIG. 6, is completely sealed, obviating the need for a rotating seal; such sealing is possible because of the very low vapor pressure of the liquid metal. Except for the cathode structure 222, the X-ray tube illustrated in FIG. 7 is completely symmetrical about its center line, which is particularly advantageous for CT scanning applications having rotating gantries. The X-ray tube of FIG. 7 is also approximately symmetrical with respect to the diameter of rotating anode 224 because the motor and heat exchange units are located on opposite sides of the rotating anode mass. This is advantageous for balancing purposes.

The X-ray tube of FIG. 7 is energized by connecting cathode 222 to a negative DC voltage, while connecting the wall of envelope 220 and anode 224 to ground. Anode 224 is maintained at the same potential as the wall of envelope 220 by virtue of the low electrical impedance connection between the metal envelope and the anode by way of the liquid metal in gap 255 between the anode and metal core 244 and to metal tubes 250 and 252. Because shell 242, core 244 and tubes 250 and 252 are all at virtually the same electrical potential, arcing between them and the walls of envelope 220 does not occur.

Figure 8:
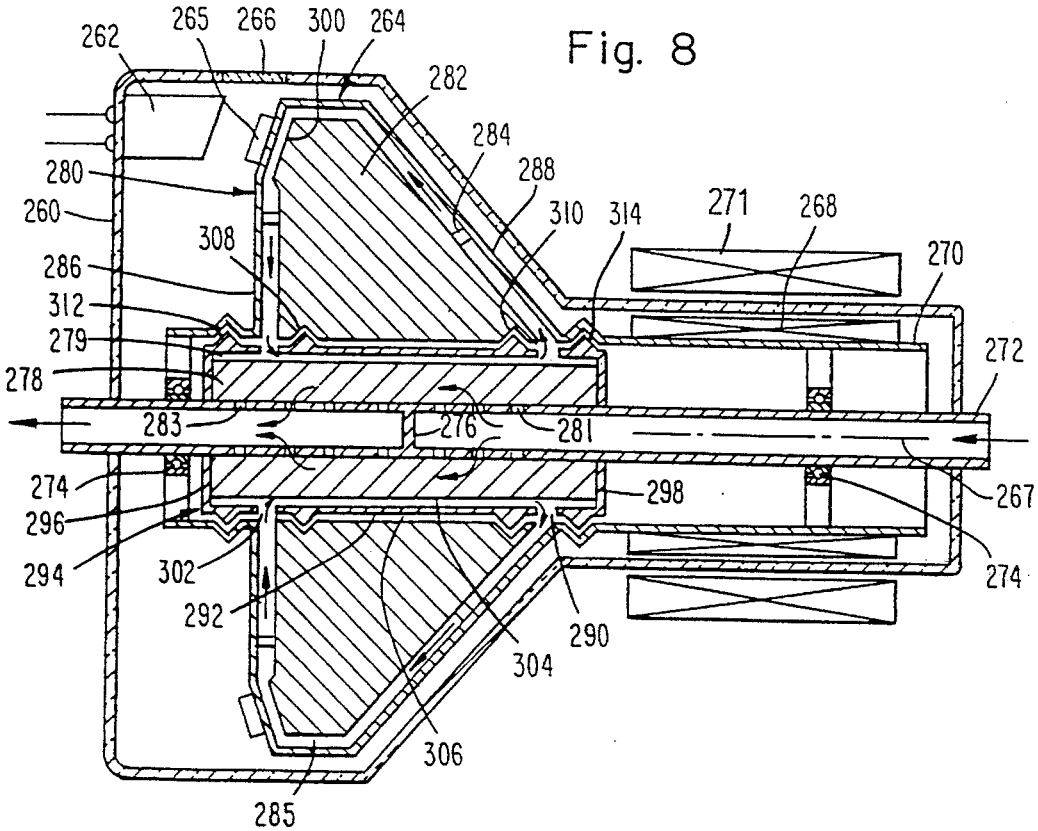
FIG. 8 is a schematic cross-sectional view of an X-ray tube wherein a liquid metal is circulated through passages of the rotating anode to a wall of a heat exchanger within the tube envelope, and a liquid metal film is between the stationary heat exchanger and a stationary structure.

Reference is now made to FIG. 8; a schematic, cross-sectional view of an X-ray tube including an internal heat exchanger for cooling a confined liquid metal recirculated through a rotating anode behind an electron bombarded X-ray emitting track on the anode. The structure illustrated in FIG. 8 includes stationary vacuum envelope 260 in which are located electron emitting cathode 262 and rotating anode 264 carrying X-ray emitting track 265. X-rays originating at track 265 propagate through window 266 in the wall of envelope 260. Anode 264 is rotated about axial center line 267 of the X-ray tube by a motor structure including exterior stator winding 271 and interior rotor winding 268, carried by sleeve 270, an integral part of anode 264.

Stationary pipe 272, fixedly connected to opposite end walls of envelope 260, extends completely through the X-ray tube. Bearings 274, mounted on pipe 272, carry the rotating structure comprising anode 264 and sleeve 270. Pipe 272 includes interior, transverse damming wall 276 for radially diverting the flow of cooling fluid (preferably water) that is applied to the right end (as viewed in FIG. 8) of pipe 272. The cooling fluid is diverted through openings 281 in pipe 272 to stationary heat exchanger 278 (described infra in detail), having an exterior wall 279 across which liquid metal for cooling anode 264 flows. The cooling fluid, after traversing heat exchanger 278, flows back into pipe 272 through openings 283, downstream of wall 276, to flow out of the left side of the X-ray tube.

Anode 264 is constructed so the liquid metal is self-pumped through it, after passing by wall 279 of heat exchanger 278. Anode 264 includes shell 280, in which is located core 282. Shell 280 and core 282 are connected together by a plurality of struts 284 so core and shell rotate together about the X-ray tube axis. Struts 284 and the walls of shell 280 and core 282 are arranged to form gap 285 between the interior shell walls and the exterior core walls. Liquid metal recirculates through gap 285 being heated by heat from track 265 and cooled by heat exchanger 278. Shell 280 and core 282 are arranged so there is a substantial axial distance between the radially extending portions of gap 285 proximate disc 286 and cone 288 of shell 280. This construction provides a relatively long flow path for the recirculated liquid metal in proximity with heat exchanger 278, to enhance cooling of the liquid metal, and prevents contact of the liquid metal with envelope 260, cathode 262, track 265, pipe 272 and the drive structure for the anode.

The liquid metal recirculating in gap 285 of anode 264 is self-pumped past heat exchanger 278 and behind track 265.

The liquid metal flows past heat exchanger 278 from left to right (as viewed in FIG. 8), counter to the flow direction of coolant fluid through the heat exchanger. From the right side of heat exchanger 278, the liquid metal flows radially through apertures 290 in cylindrical wall 292 of tube 294 having closed end walls 296 and 298 fixedly connected to pipe 272, to completely enclose heat exchanger 278. From apertures 290, the liquid metal flows radially outward through the portion of gap 285 between the "back" wall of core 282 and cone 288. From this portion of gap 285, the liquid metal flows parallel to center line 267 of the X-ray tube to the portion of the gap between the "front" wall of core 282 and disc 286.

Core 282 includes protuberance 300 opposite from the portion of disc 286 where track 265 is located, i.e., the hottest portion of the disc. Thereby, gap 285 between shell 280 and core 282 is narrower behind track 265 than any other part of the gap. This construction increases the flow rate of the liquid metal to provide increased heat transfer from the hottest region of rotating anode 264 to the liquid metal. From the portion of gap 285 behind track 265 the hot liquid metal flows through aperture 302 back to cylindrical gap 304 between heat exchanger 278 and cylindrical wall 292.

By flowing the liquid metal through stationary gap 304, shear forces between rotating core 282 and stationary tube 294 are reduced and the motor drive power requirements of stator winding 271 and total heat produced in the X-ray tube are decreased.

Core 282 is preferably formed of a low density material capable of withstanding the corrosive effects of gallium or an alloy thereof, e.g., carbon or graphite. Low density materials are preferred because less bearing loading promotes bearing life and the reduced power required accelerate and decelerate the anode structure.

To assist in minimizing the mass of the rotating parts and the power requirements of stator winding 271, gap 306 is placed between facing cylindrical surfaces of rotating core 282 and stationary cylindrical wall 292. The liquid metal flowing in gap 285 between facing walls of shell 280 and core 282 must not enter gap 306. If the liquid metal were to enter gap 306, it would cause greater drag, thereby increasing the electrical power required by stator winding 271.

To prevent the liquid metal from entering gap 306, labyrinths 308 and 310 are provided at opposite ends of the gap. Labyrinths 308 and 310 are coated with a material that is not wetted by the recirculating liquid metal; labyrinths 308 and 310 are formed in facing surfaces of core 282 and cylinder wall 292. Similar labyrinths 312 and 3 14 with non-wettable walls are located to the left and right, respectively, of apertures 290 and 302, to prevent the liquid metal from (1) flowing out of its confined flow path and (2) spilling into the remainder of the X-ray tube.

During operation, while anode 264 is rotating, water or other coolant is introduced into pipe 272 and flows from right to left (as illustrated in FIG. 8), through heat exchanger 278, thence back to pipe 272 and through an outlet at the left side of the pipe. Water flows in heat exchanger 278 counter to the direction of flow of the liquid metal past the heat exchanger. The liquid metal is self-pumped in a direction opposite to the direction of water flow through the heat exchanger in response to the liquid metal being heated by the electrons incident on anode track 265 and the geometry of apertures 290 and 302.

Figure 9A:
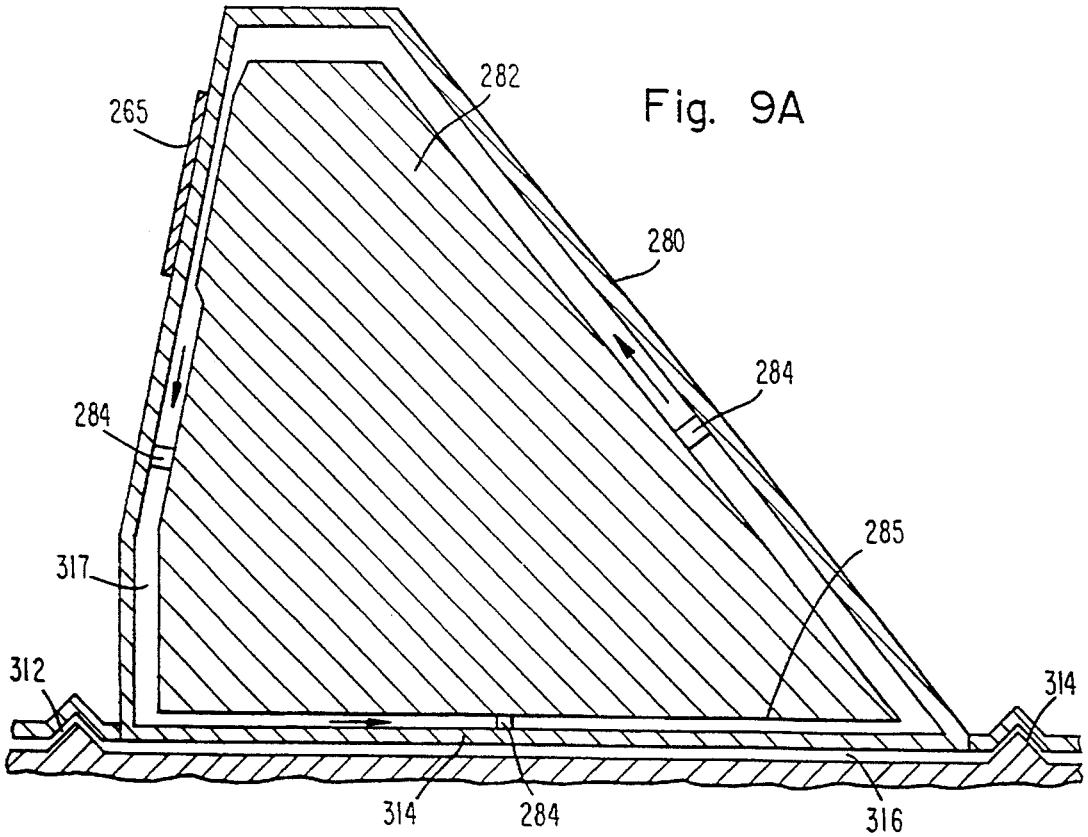
FIG. 9A is a schematic cross-sectional view of a portion of an X-ray tube wherein a liquid metal circulated within a rotating anode is in thermal contact with a heat exchanger via a second metal film between a stationary surface of the heat exchanger and the rotating anode.

Reference is now made to FIG. 9A of the drawing, a schematic diagram of part of an X-ray tube similar to the X-ray tube illustrated in FIG. 8. In the X-ray tube of FIG. 9A, the liquid metal continuously circulates in gap 317 within the confines of rotating anode 264, between opposed, adjacent walls of shell 280 and core 282. The liquid metal recirculated in gap 317 never directly contacts the envelope, target, cathode, anode, drive structure or heat exchanger 278. Instead, a high thermal conductance path is established between heat exchanger 278 and the liquid metal recirculated through anode 264 by a liquid metal film in gap 316 between facing spaced coaxial cylindrical walls of the heat exchanger and shell 280.

To these ends, shell 280 includes cylindrical metal wall 319, coaxial with center line 267 of the X-ray tube illustrated in FIG. 8. Wall 319 extends completely between disc 286 and cone 288, so it is spaced from and parallel to cylindrical wall 285 of core 282. Struts 284 connect the three major adjacent walls of shell 280 and core 282 together. The cylindrical wall of heat exchanger 278 and cylindrical wall 319 of shell 280 are spaced from each other by gap 316. Gap 316 is filled with a liquid metal film which cannot escape to the remainder of the X-ray tube because of labyrinths 312 and 314, coated with a material that is not wetted by the liquid metal in gap 316. A high thermal conductance path is thereby provided from heat exchanger 278 through the liquid metal film in gap 316 and metal wall 319 of shell 280 to the liquid metal recirculated in gap 317 between shell 280 and core 282.

Figure 9B:
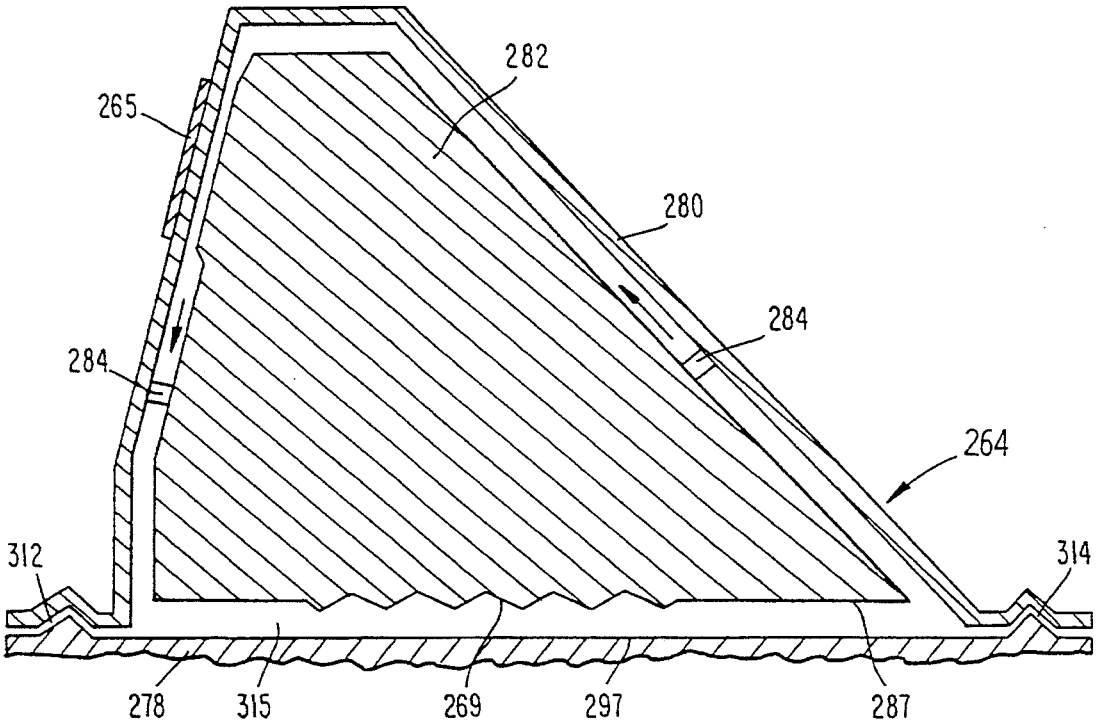
FIG. 9B is a schematic cross-sectional view of a portion of an X-ray tube wherein a liquid metal is circulated in a rotating anode in contact with a heat exchanger and a spiral groove pump.

Reference is now made to FIG. 9B, an alternative arrangement of the anode structure and liquid metal flow pattern of an X-ray tube similar to the X-ray tube illustrated in FIG. 8 and the anode of FIG. 9A. Anode 264 of FIG. 9B includes shell 280, in which is located core 282. Shell 280 and core 282 are connected together by struts 284 so they both rotate together about the X-ray tube axis. Struts 284 and the walls of shell 280 and core 282 are arranged so gap 315 exists between the interior shell walls and the exterior core walls, and along the axis between the heat exchanger wall 297 and the core surface 287. The liquid metal recirculates through gap 315, being heated by heat from anode track 265 and cooled by heat exchanger 278. The heated liquid metal proximal the anode track has a lower density and is replaced by cooler liquid metal flowing from heat exchanger 278. The greater centrifugal force on the cooler more dense liquid provides some self-pumping action.

Tube 294 of FIG. 8 has been eliminated, making the structure of FIG. 9B somewhat simpler. In operation, as anode 264 is rotated, the liquid metal in contact with core surface 287 tends to rotate with this surface while liquid metal in contact with heat exchanger wall 297 tends not to rotate, thereby setting up a shear in the liquid metal spanning gap 315 between these two surfaces. The friction losses of this shear are supplied by the motor structure.

To assist the recirculation of the liquid metal, helical grooves 269 are formed on the inside cylindrical face of core 282. In operation the helical grooves on the core tend to propel the liquid metal as the grooves rotate, acting much as fan blades. Helical grooves that have the sense of a right-handed inside thread propel the liquid from left to right as viewed in FIG. 9B when the anode 264 is turning counter-clockwise as viewed from the left side of FIG. 9B.

As an alternative, or in addition to the helical grooves 269 formed on core 282, helical grooves can be formed on wall 297 of heat exchanger 278. Helical grooves on either heat exchanger wall 297 or core surface 287 or on both surfaces can be used to increase the flow rate of the recirculating liquid metal.

Liquid metal in gap 315 cannot escape to the remainder of the X-ray tube because of labyrinths 312 and 314 coated with a material that is not wetted by the liquid metal.

In one arrangement the shells of FIGS. 6–9 are made of molybdenum because it is able to withstand the corrosive effects of gallium and gallium alloys, while the cores are made of graphite because its low density reduces bearing wear. Channels or partitions (not shown in FIGS. 6–9) in the radially extending exterior walls of the core and/or the interior walls of the shell cause the recirculating liquid metal to have the same angular velocity it had while flowing outward along a radial path. The shells are made as two matching halves having peripheries that form a seal when joined together by suitable means, e.g. by bolts using a carbon gasket, by brazing or electron-beam welding. The seal must be very tight because the spinning gallium develops a centrifugal force equivalent to a pressure of many atmospheres on the interior wall of the shell. Otherwise, the spinning gallium is likely to escape outside the shell.

Figure 10A:
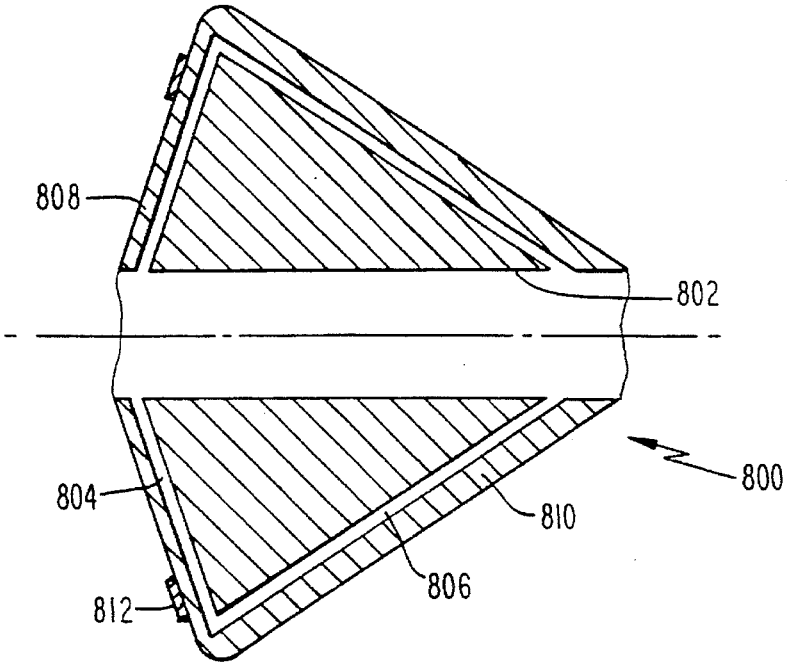
FIGS. 10A and B are respectively side cross-sectional and front views of pyrolytic graphite anodes of the type that can generally be used in any of FIGS. 6–9.
Figure 10B:
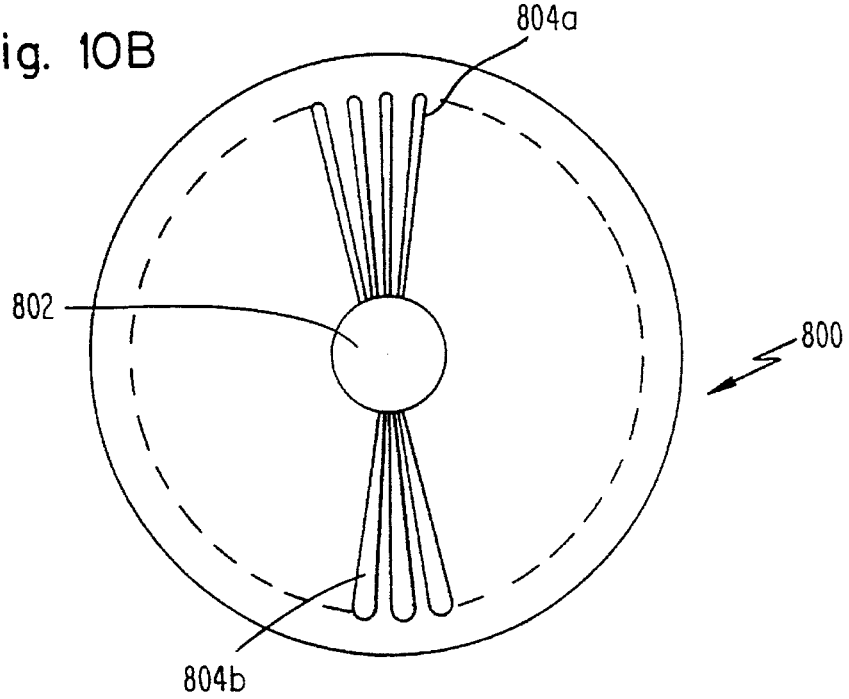

In another arrangement, the shell and core are both made from a single solid carbon or graphite block 800 having a generally conical shape and a central cylindrical bore 802, as illustrated in FIG. 10A. Channels 804 and 806, where the liquid metal flows, are formed by drilling bores parallel to front and back walls 808 and 810, respectively. For each of channels 804 and 806, a drill bit is started in the wall of bore 802 and proceeds parallel to the adjacent wall 808 or 810 but does not penetrate the wall toward which it is moving. All of channels 804 and 806 have constant diameter in one embodiment as shown by channels 804*a* in FIG. 10B. In a second embodiment, all of channels 804 and 806 have larger diameters close to the periphery of block 800 than in proximity to bore 802, as shown by channels 804*b*. Channels 804*b* have the advantage of lower flow resistance. Channels 804*b* can be formed by first drilling constant diameter bores and then reaming to form the taper. The structure of FIGS. 10A and 10B obviates the sealing problems of a split shell and is relatively easy to fabricate because graphite is readily available in suitably sized blocks and easily machined. X-ray emitting track 812 is formed on wall 808 by physical or chemical vapor deposition.

Figure 11:
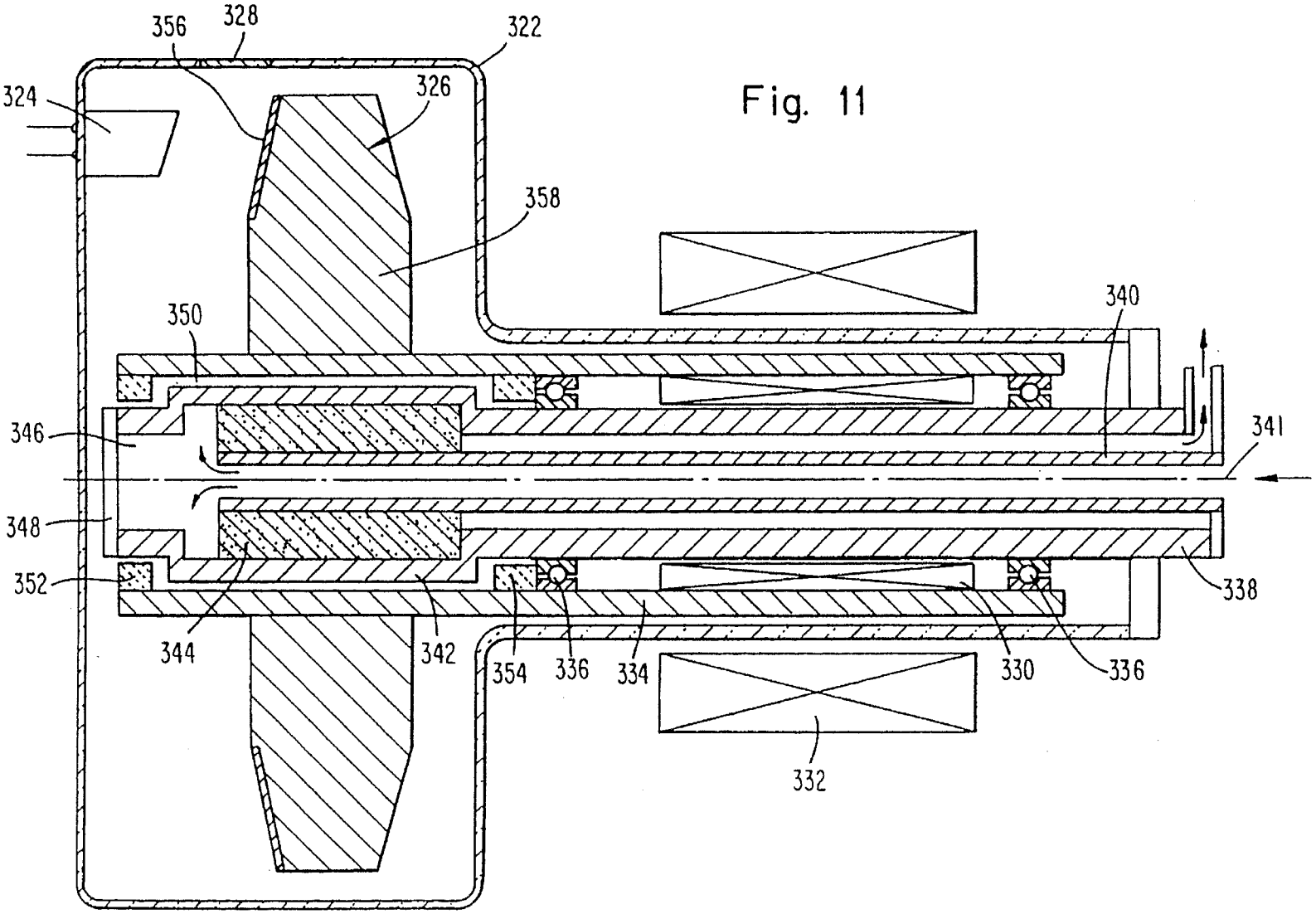
FIG. 11 is a schematic cross-sectional view of another embodiment of an X-ray tube including a film of liquid metal between a rotating anode and a centrally located heat exchanger of porous metal in accordance with the present invention.

Reference is now made to FIG. 11 of the drawing, a further embodiment of the invention including vacuum envelope 322 in which are located cathode 324, rotating anode 326, X-ray transparent window 328 and a motor structure including rotor winding 330 and external stator winding 332. Rotor winding 330 is carried by rotating sleeve 334 on which anode 326 is mounted. As an alternative, rotor winding 330 may be carried on the outer diameter of rotating sleeve 334. Sleeve 334 is carried by bearings 336, in turn mounted on stationary tube 338, fixedly attached to the wall of vacuum envelope 322. Fixedly mounted within tube 338 is pipe 340 through which cooling fluid (preferably water) flows axially. All of rotating sleeve 334, tube 338 and pipe 340 are coaxial with longitudinal axis 341 of the X-ray tube.

Tube 338 includes enlarged cylindrical portion 342 axially aligned with anode 326. Cylindrical heat exchanger 344 is located between the interior wall of enlarged portion 342 and the exterior wall of pipe 340. The cooling fluid flows from pipe 340 to heat exchanger 344, after reversing flow direction in cavity 346 between the downstream end of pipe 340 and end wall 348 of tube 338. The cooling fluid, after traversing heat exchanger 344, flows axially through tube 338 between the interior wall of the tube and the exterior wall of pipe 340.

A high thermal conductance path is provided between the exterior wall of heat exchanger 344 and anode 326 by a liquid metal film in gap 350 between the exterior of enlarged cylindrical portion 342 and rotating sleeve 334. The liquid metal film in gap 350 is confined to the gap by labyrinths 352 and 354, positioned between tube 338 and sleeve 334, just beyond the shoulders of enlarged cylindrical portion 342.

Anode 326 is made of high thermal conductivity material, preferably copper, molybdenum or tungsten. Anode track 356 is tungsten or other material with a high atomic number for the production of bremstrahlung X-rays. Heat generated by electron bombardment of track 356 flows through body 358 and sleeve 334, across liquid metal film in gap 350 to heat exchanger 344.

Figure 12:
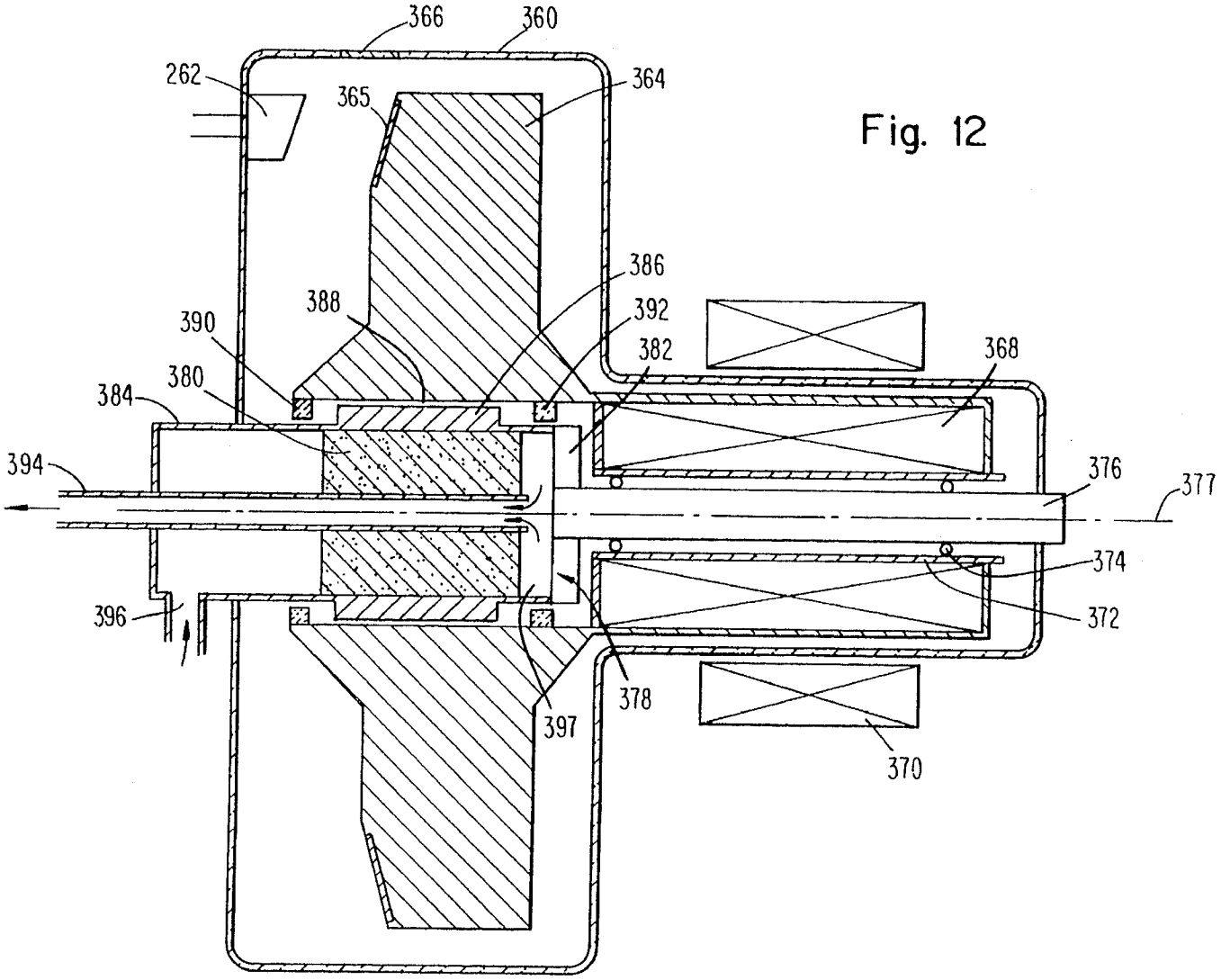
FIG. 12 is a further embodiment of an X-ray tube similar to the tube of FIG. 11, wherein the coolant flow path to and from the heat exchanger is modified relative to the embodiment of FIG. 11.

Reference is now made to FIG. 12 of the drawing, a schematic view of still another embodiment of the X-ray tube of the invention wherein the geometry of the heat exchange fluid flow path and the motor structure of the X-ray tube are reversed relative to the structure of FIG. 11. The X-ray tube illustrated in FIG. 12 includes vacuum envelope 360, within which are located cathode 362, rotating anode 364 (including X-ray emitting track 365), X-ray window 366, and rotor winding 368, magnetically coupled to exterior stator winding 370. Rotor winding 368 is carried by sleeve 372, in turn carried by bearings 374, mounted on stationary, central rod 376, having an axis on X-ray tube center line 377. Opposite ends of rod 376 are respectively fixedly mounted to the wall of vacuum envelope 360 and housing 378 for heat exchanger 380.

Housing 378 includes end wall 382 and cylindrical side wall 384, including protruding portion 386, generally axially aligned with and located within anode 364. Gap 388 between the exterior wall of protruding portion 386 and the interior cylindrical wall of anode 364 is filled with a liquid metal film. The liquid metal film in gap 388 is prevented from leaking to the remainder of the X-ray tube interior by labyrinth seals 390 and 392, located somewhat beyond the shoulders of protruding portion 386 between the exterior wall of tube 384 and the interior wall of anode 364. The volume between the shoulders of protruding portion 386 and labyrinth seals 390 and 392 is an expansion space for the liquid metal film in gap 388. Metal protruding portion 386 assists in providing high thermal conductance for heat flow from anode 364 to the metal mass and cooling fluid in heat exchanger 380.

Cooling fluid (typically water), at basically atmospheric pressure, flows to heat exchanger 380 by way of pipe 396. From the heat exchanger, the cooling fluid flows axially through centrally located pipe 394 from right to left, as illustrated in FIG. 12, after reversing direction in cavity 397, between the heat exchanger and wall 382.

Figure 13:
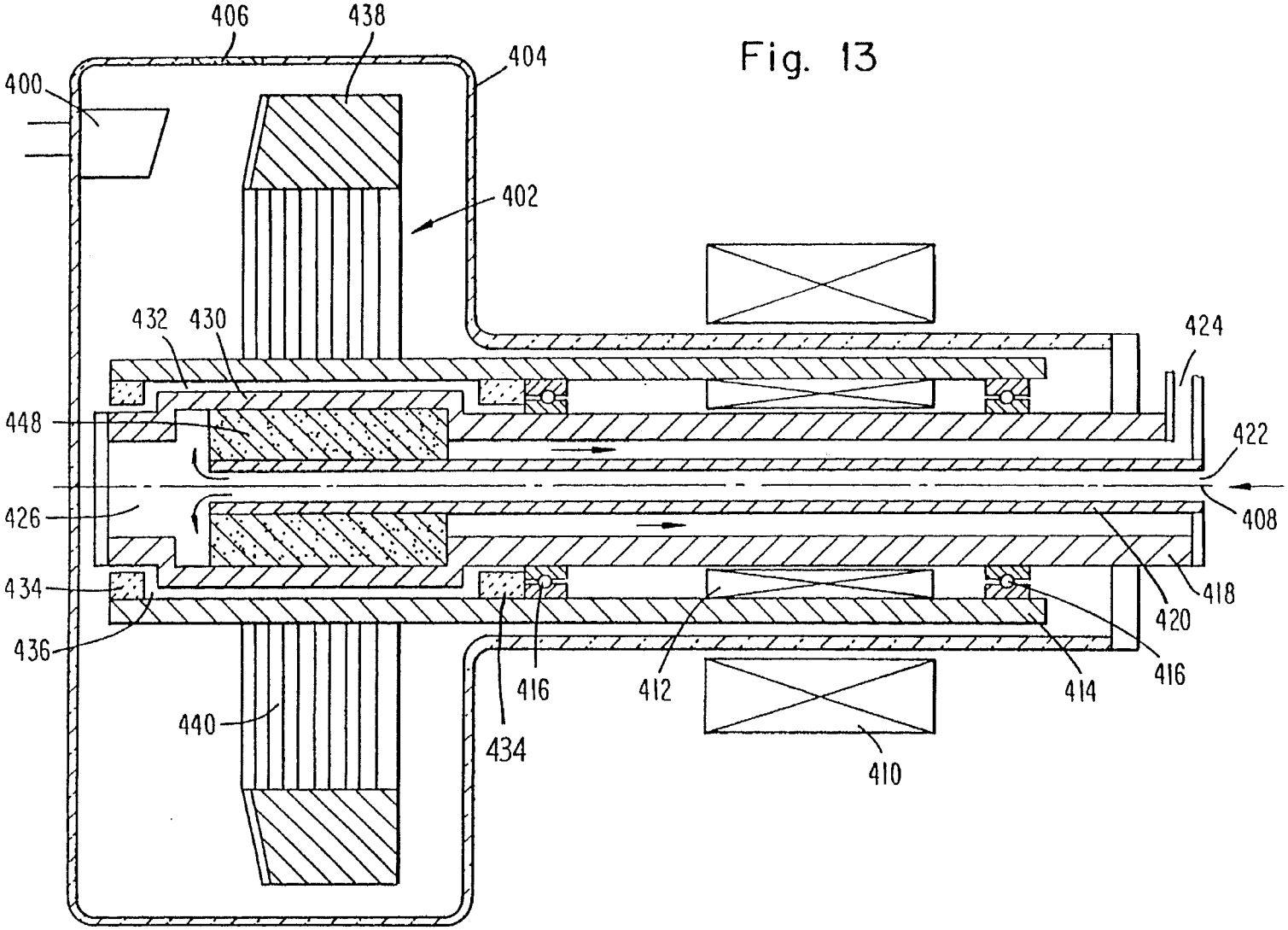
FIG. 13 is a schematic view of another embodiment of an X-ray tube in accordance with the invention wherein the rotating anode also includes stacked parallel pyrolytic graphite plates.

Reference is now made to FIG. 13 of the drawing, a schematic diagram of still another embodiment of the present invention having increased thermal conduction between the heated anode region and a heat exchanger. In the embodiment of FIG. 13, stationary cathode 400 and rotating anode 402 are mounted in vacuum envelope 404, including X-ray window 406. Anode 402 is rotated about the longitudinal axis 408 of envelope 404 by a motor structure including external stator winding 410 and internal rotor winding 412. Rotor winding 412 is carried on sleeve 414, concentric with axis 408. Sleeve 414 is carried by bearings 416, which in turn are mounted on tube 418 which is attached to envelope 404. Pipe 420 is fixedly mounted to tube 418 within envelope 404; tube 418 and pipe 420 are concentric with axis 408.

Pipe 420 includes an inlet 422 for cooling fluid (water), while the region between the exterior wall of pipe 420 and the interior wall of tube 418, in proximity to the inlet is outlet 424 for the cooling fluid. The cooling fluid flowing through pipe 420 flows into chamber 426 at the far end of tube 418 from inlet 422. The cooling fluid flow direction is reversed in chamber 426; from chamber 426, the cooling fluid flows through heat exchanger 448, located in a cavity between an enlarged radial wall segment 430 of tube 418 and pipe 420. The cooling fluid, after flowing through heat exchanger 448, flows axially between the exterior wall of pipe 420 and the interior wall of tube 418 to outlet 424.

Heat exchanger 448 is axially aligned with the region where rotating anode 402 is connected to sleeve 414. To provide a high thermal conductivity path between heat exchanger 448 through wall segment 430 to rotating anode 402, a liquid metal (gallium or gallium alloy) film 432 exists between the exterior of wall segment 430 and the facing portion of sleeve 414. Labyrinth seals 434, made of a non-gallium or gallium alloy wettable material, are mounted on opposite sides of the gap where film 432 is located. Wall segment 430 is constructed and labyrinth seals 434 are positioned so gap 436 exists between the radially extending portions of the wall segment and the labyrinth to provide for expansion of the liquid metal as the liquid metal is heated by heat transferred to it from anode 402.

To promote the transfer of heat from the exterior portion 438 of anode 402, on which electrons from cathode 400 are incident, the anode includes radially extending anisotropic pyrolytic graphite plates 440. Plates 440 are bonded to exterior portion 438 and sleeve 414, and are arranged so the crystalline axes thereof cause heat to be conducted radially from the exterior portion 438 thereof to sleeve 414. Thereby, a path of high thermal conductivity is established between exterior portion 438, where heat is generated in response to electrons from cathode 400 being incident thereon, through the pyrolytic graphite plates 440, metal sleeve 414, liquid metal film 432, and metal tube 418 to heat exchanger 448.

Figure 14:
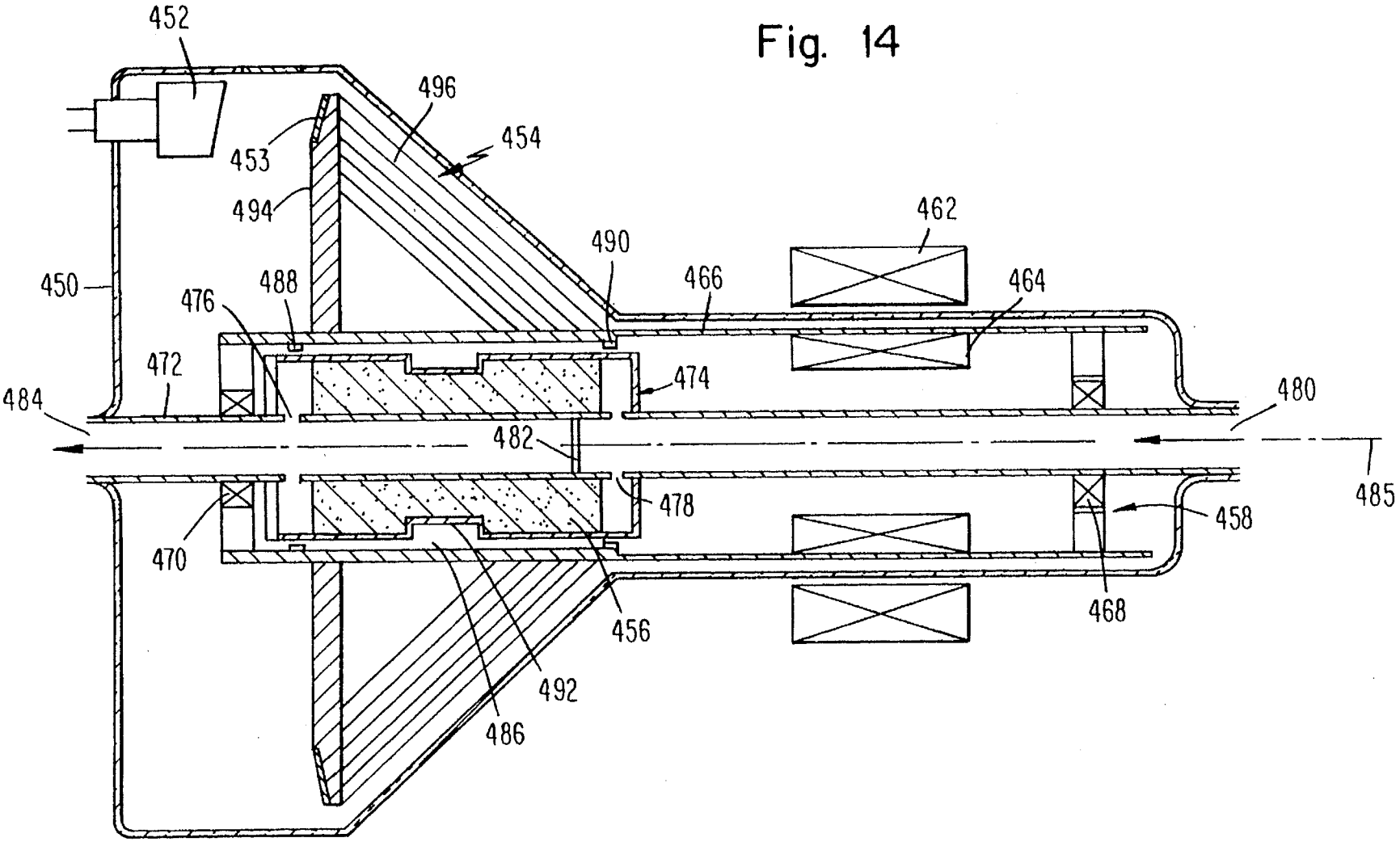
FIG. 14 is a schematic side view of an X-ray tube according to a further embodiment of the invention wherein the rotating anode track is connected by nested pyrolytic graphite cones to a central heat exchanger.

A further embodiment of an X-ray tube in accordance with the present invention is illustrated in FIG. 14. In the structure of FIG. 14, the thermal path between the heat source, track 453, at the periphery of rotating anode 454, has a high thermal conductivity. A less complex feed arrangement is provided for the cooling fluid (e.g. water). The structure of FIG. 14 also has great mechanical stability because bearings 468 and 470 are located at the ends of support structure 458 for rotating anode 454.

The structure of FIG. 14 includes vacuum envelope 450 containing electron emitting cathode 452, rotating anode 454, stationary heat exchanger 456 and rotating anode support structure 458. Anode 454 is rotated about longitudinal tube axis 485 by a motor structure including stator 462 (exterior to envelope 450) and rotor coil 464 mounted on sleeve 466, coaxial with axis 485. Sleeve 466 is carried by bearings 468 and 470, positioned at opposite ends of the sleeve and carried by pipe 472 secured on opposite ends of enclosure 450.

Heat exchanger 456 and housing 474 are fixedly mounted on pipe 472. Housing 474 extends axially beyond opposite end faces of heat exchanger 456. Pipe 472 includes apertures 476 and 478 so fluid can flow between pipe 472 and housing 474, located between the end walls of the housing and heat exchanger 456. Cooling fluid applied to open end 480 of pipe 472 flows axially through the pipe, from right to left (as illustrated in FIG. 14) until it reaches plug 482, just downstream of apertures 478. The cooling fluid flows radially through openings 478 and thence axially through heat exchanger 456, to cool the heat exchanger. The fluid, after flowing through heat exchanger 456, flows radially back to pipe 472 through apertures 476, and then flows through open end 484 of pipe 472.

A high thermal conductance path exists between anode 454 and heat exchanger 456 as a result of a liquid metal film in gap 486 between the periphery of the side wall of housing 474 and the inner diameter of sleeve 466. The film in gap 486 is confined to the region inside anode 454 by labyrinths 488 and 490, coated with a material that is not wettable by the liquid metal film. The side wall of housing 474 includes central indentation 492 which provides expansion space for the liquid metal as it is heated during operation.

Anode 454 is another construction to provide efficient and effective transfer of heat from the anode track 453 to heat exchanger 456. To this end, anode 454 includes disc 494 extending radially from sleeve 466. Disc 494 is attached to sleeve 466 so an end wall of heat exchanger 456 and the "forward" face of disc 494 are substantially aligned. Anode 454 also includes a set of nested pyrolytic graphite cones 496. Opposite edges of cones 496 are bonded to the exterior wall of sleeve 466 and the region on the "back" face of disc 494 opposite from track 453. Cones 496 are fabricated and assembled so the crystalline structure of the pyrolytic graphite forming the cones has its high thermal conductivity axis directed between disc 494 and sleeve 466 and its lower thermal conductivity direction at right angles to that axis. Because there are large contact surface areas between cones 496 and the back face of disc 494 and between cones 496 and sleeve 466 a high thermal conductivity path exists between track 453 and sleeve 466. Cones 496 are bonded to sleeve 466 at a region on the sleeve that is axially aligned with almost the entire mass of heat exchanger 456 between indentation 492 and the heat exchanger "back" end wall.

Pyrolytic graphite is advantageously used for the anodes in the structures of FIGS. 13 and 14 because it has a thermal conductivity three to four times that of copper in crystalline planes of the graphite; pyrolytic graphite has very low thermal conductivity in a direction perpendicular to the crystalline planes. Hence the stacked pyrolytic graphite structures of FIGS. 13 and 14 are very efficient heat transfer devices. Because pyrolytic graphite has a density that is approximately one quarter that of copper loading on the bearings is reduced, leading to longer bearing life.

The various internal heat exchangers of FIGS. 8, 9 and 11–14 are fabricated so heat is transferred radially between the cooling fluid flowing axially through the heat exchanger and a liquid metal surrounding and contacting the heat exchanger housing metal wall. A high thermal conductivity path exists between the heat exchanger housing wall and the liquid metal in contact with the wall and the cooling fluid flowing inside the heat exchanger. One arrangement for accomplishing such a result is to provide a porous mass of high thermal conductivity material (preferably metal and particularly copper) through which the cooling fluid, e.g., water, flows radially or axially in FIGS. 8 and 9 and flows axially in FIGS. 11–14. Heat is transferred to the porous mass of metal from the rotating anode, thence through the liquid metal and from the liquid metal through a sleeve surrounding the porous metal of the heat exchanger. Such a porous mass is attained by bonding many high thermal conductivity particles, made, e.g. of copper, having approximately the same small size. In one embodiment the particles are spherical in shape; in another embodiment they are irregularly shaped grains. Adjacent particles tightly abut against each other, forming a relatively tortuous path for the cooling fluid flowing between the particles, while providing a high thermal conductance path from the cooling fluid through the abutting particles to the metal walls of the heat exchanger housing, thence through the liquid metal film to the anode. The particles may be diffusion bonded or brazed together to improve radial heat transfer through the heat exchanger.

Figure 15:
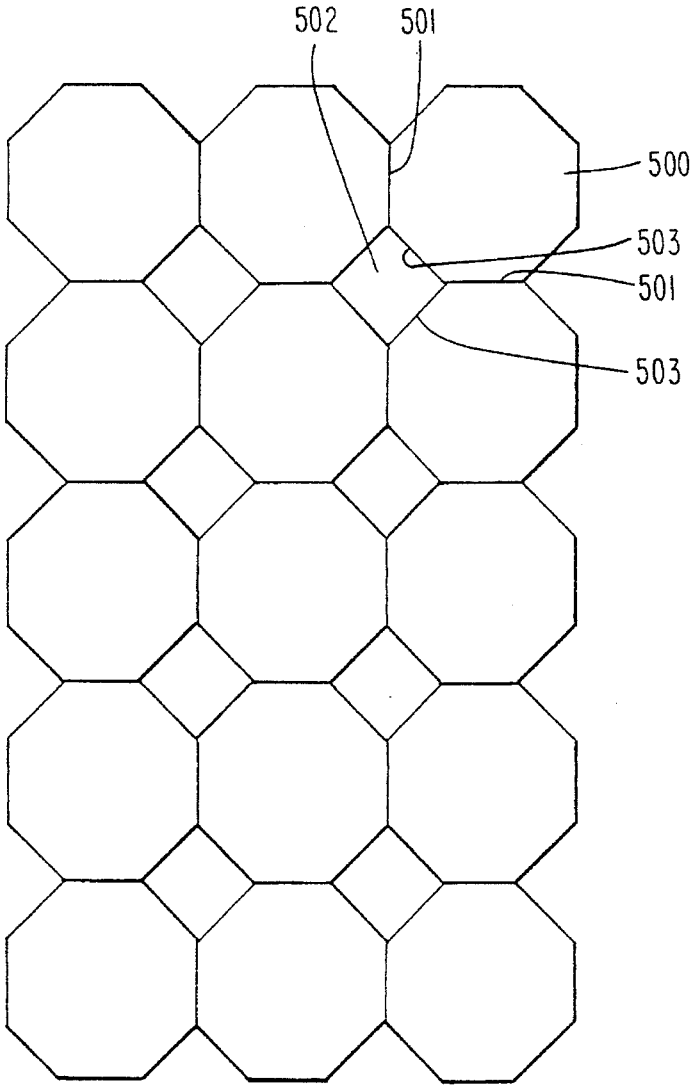
FIGS. 15 and 16 are cross-sectional end views of different heat exchanger core shapes that can be used in the embodiments of FIGS. 11–14.

An end view of an alternative heat exchanger for the embodiments of FIGS. 11–14 is illustrated in FIG. 15; the heat exchanger is illustrated in FIG. 15 in a plane at right angles to the flow direction of the cooling fluid through the heat exchanger. The heat exchanger of FIG. 15 includes a high thermal conductivity matrix of solid (preferably a metal and particularly copper) solid wires 500, arranged in a honeycomb cross-section so each wire has the same cross-sectional area and shape of a regular octagon. Adjacent wires 500 have abutting walls 501 bonded to each other, e.g. by diffusion bonding or brazing. Each of wires 500 also includes sloping walls 503, displaced by 45° from mutually orthogonal walls 501. The honeycomb arrangement of wires 500 is such that the sloping walls 503 of adjacent wires are spaced from each other to form conduits 502 through which the cooling fluid (water) flows axially. The arrangement of FIG. 15 thus provides a high thermal conductivity heat path from the liquid metal, through the heat exchanger housing wall contacting the exterior wires of the bundle, to the cooling fluid flowing in conduits 502.

Figure 16:
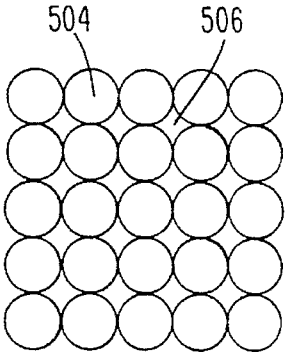

A further arrangement for the heat exchanger embodiments of FIGS. 11–14 illustrated in FIG. 16 includes solid round wires 504, each having the same diameter. Adjacent wires 504 have bonded abutting contact regions. Between these contact regions are axially extending conduits 506. The cooling fluid flows axially through conduits 506 between the adjacent circular cross-section wires 504 to provide a result similar to that described in connection with FIG. 15. The structure of FIG. 15, however, is preferable to that illustrated in FIG. 16 because in FIG. 15 there is greater thermal conductance between the heat exchanger housing wall and the cooling fluid flowing through the heat exchanger. This is because there is (1) greater contact area between the adjacent metal wires in the structure of FIG. 15 and (2) more space between the adjacent abutting wires for the flowing cooling fluid. As with the heat exchanger in FIG. 15, the abutting wires may be diffusion bonded or brazed together to improve radial heat transfer through the exchanges. The heat exchanger matrix can also be made of brazed together copper shot coated with a thin layer of fusible material, such as silver.

Typically the anode track has been described as made from tungsten; however other heavy elements may be used to produce bremstrahlung X-rays and, as is well known in the art, other materials for the production of characteristic X-rays.

In the figures a specific direction of flow has been indicated for the coolant fluid; however, this direction may be reversed without a substantial change in operating conditions.

While there have been described and illustrated several specific embodiments of the invention, it will be clear that variations in the details of the embodiments specifically illustrated and described may be made without departing from the true spirit and scope of the invention as defined in the appended claims.

We claim:

1. A vacuum tube comprising a vacuum chamber including:

a cathode, and anode having a rotatable track responsive to electrons derived from the cathode; and means for cooling said anode track, said cooling means including: a liquid metal having sufficiently low vapor pressure at the anode operating temperature and chamber pressure so the liquid metal does not vaporize while the tube is operating, a closed recirculating flow path to allow the liquid metal to flow through the anode in proximity to the anode track, said recirculating flow path configured with a geometry to create a self pumping action of the liquid metal in response to forces applied to said liquid metal by heat transferred from the anode to the liquid metal by rotation of said anode, and a stationary heat exchanger in heat exchange relation with the liquid metal in the recirculating flow path, the flow path being confined between opposing wall segments extending along the direction of flow of liquid metal such that the liquid metal is to be continually recirculated in the vacuum chamber.

2. The tube of claim 1 wherein the flow path is constructed and arranged so the liquid metal is always at substantially the same pressure as the vacuum chamber while it is in the flow path.

3. The tube of claim 1 wherein the recirculating flow path is arranged and has a geometry so the liquid metal is pumped in said path in response to mechanical forces applied to the liquid.

4. The tube of claim 1 wherein the anode has a central axis about which the track is rotatable, the track being displaced from the central axis, the flow path through the anode including a first portion arranged so the liquid metal flows radially from the vicinity of the axis toward the vicinity of the track and a second portion arranged so the liquid flows radially from the vicinity of the track back to the vicinity of the axis.

5. The tube of claim 4 wherein the heat exchanger is in the vicinity of the axis.

6. The tube of claim 5 wherein the anode is constructed so facing radially extending walls of the flow path through the anode are rotatable together about the axis at the same speed as the anode.

7. The tube of claim 6 wherein the flow path includes first and second segments extending in the direction of the axis so the liquid flows therein in opposite directions relative to the axis.

8. The tube of claim 7 wherein the first segment is along the axis and the second segment surrounds the first segment, the flow path being arranged so the flow of the liquid metal in the path is such that the liquid metal flows in the second portion toward the axis, thence in the first segment and thence in the first portion away from the axis.

9. The tube of claim 7 wherein the anode includes a narrow passage extending in the direction of the axis and arranged to prevent the flow of the liquid metal through it, one end of said opening being into the flow path.

10. The tube of claim 7 wherein the first segment is along the axis and the second segment surrounds the first segment, the flow path being arranged so the flow of the liquid metal in the path is such that the liquid metal flows in the second portion toward the axis thence in the second segment, thence in the first segment and thence in the first portion away from the axis.

11. The tube of claim 10 wherein the anode has a central axis about which a portion of the anode including the track is rotatable, the track being displaced from the central axis, the rotatable anode portion having a wall defining a side of a narrow passage extending generally in the direction of the axis, the passage having an end opening into the flow path, the passage being arranged to prevent the flow of the liquid metal through it.

12. The tube of claim 11 wherein an opposing wall of the passage is fixed.

13. The tube of claim 11 wherein the passage is constructed as a labyrinth.

14. The tube of claim 13 wherein the labyrinth has walls that are not wettable by the liquid metal.

15. The tube of claim 11 wherein another end of the passage has an opening into the flow path.

16. The tube of claim 15 wherein the passage is between first and second portions of the flow path that extend radially of the axis, the liquid metal flowing away from the axis toward the track in the first portion, the liquid metal flowing toward the axis and away from the track in the second portion.

17. The tube of claim 16 wherein an opposing wall of the passage is fixed.

18. The tube of claim 17 wherein the path includes first and second coaxial segments extending in the direction of the axis and arranged so the liquid metal flows from the first portion to the second segment and flows from the second segment to the second portion, the second segment having a greater radius relative to the axis than the first segment.

19. The tube of claim 18 wherein the first segment has an open end adjacent the first portion so the liquid metal flows through the first segment open end from the first portion.

20. The tube of claim 18 wherein another passage is formed between another wall of the rotatable portion of the anode and a fixed wall, the another passage having first and second openings into the path and into a volume substantially at the pressure within the tube envelope, respectively, the another passage being arranged to prevent the flow of the liquid metal through it.

21. The tube of claim 10 wherein the path includes an elongated segment extending in the direction of the axis between the first and second portions, the elongated segment having opposite openings adjacent the first and second portions so the liquid metal flows from the segment through one of the openings into the first portion and from the second portion through the other opening into the segment.

22. The tube of claim 21 wherein the segment and passage are coaxial with the axis.

23. The tube of claim 22 wherein the segment has a pair of opposing fixed walls and the passage has opposing first and second walls which are respectively rotatable with the anode and fixed.

24. The tube of claim 23 wherein the segment is closer to the axis than the passage.

25. The tube of claim 22 wherein the segment has opposing first and second walls which are respectively rotatable with the anode and fixed.

26. The tube of claim 23 wherein the passage is closer to the axis than a portion of the segment.

27. The tube of claim 5 wherein the flow path includes first and second portions extending radially in the anode so the fluid flows in the first and second portions in opposite directions relative to the axis, a passage extending in the direction of the axis between the first and second portions arranged so the liquid flows between the first and second portions via the passage, the heat exchanger having heat exchange surfaces between the passage and the axis in heat exchange relation with the liquid metal flowing in the passage.

28. The tube of claim 27 further including means for supplying coolant from a source different from the liquid metal to the heat exchanger.

29. The tube of claim 27 wherein the anode is constructed so all wall segments of the first and second portions rotate together with the anode region, the passage being within the anode so it rotates at the same speed as the anode.

30. The tube of claim 29 wherein the anode and the heat exchanger are constructed so there is an elongated gap extending in the direction of the axis between them, a film of liquid metal confined in said gap so a thermal conduction path is provided in heat exchange between the anode and the heat exchanger through the film, the liquid metal of the film being isolated from the liquid metal of the recirculating flow path.

31. The tube of claim 29 wherein the liquid metal of the film is confined by a labyrinth having surfaces that are not wettable by the liquid metal so there is a tendency for the liquid metal of the film not to pass through the gap.

32. The tube of claim 27 wherein the anode is constructed so all wall segments of the first and second portions are rotatable together with the anode region, the passage being exterior of the anode.

33. The tube of claim 32 wherein all walls of the passage are stationary.

34. The tube of claim 33 wherein the passage and anode are constructed so there is an elongated gap between an interior wall of the anode and an exterior wall of a structure forming the passage, the interior and exterior walls having openings for the liquid metal, and means for substantially preventing the flow of the liquid metal into the gap.

35. The tube of claim 34 wherein the flow preventing means includes a labyrinth having surfaces that are not wettable by the liquid metal.

36. The tube of claim 35 wherein one of said labyrinths is included at each opposite end of the elongated gap adjacent the openings.

37. The tube of claim 3 wherein the flow path includes first and second axially extending segments, one of the segments being along the axis and the other segment surrounding the first segment, the flow path being arranged so the flow of the liquid metal in the path in the second portion is toward the axis, thence in one of the segments, thence in the other segment and thence in the first portion away from the axis.

38. The tube of claim 37 wherein the first segment is the one segment and second segment is the other segment.

39. The tube of claim 38 wherein one wall of each of the first and second portions is stationary and another wall of each of the first and second portions rotates with the track.

40. The tube of claim 37 wherein the second segment is the one segment and first segment is the other segment.

41. The tube of claim 40 wherein all walls of the first and second portions rotate with the track.

42. The tube of claim 41 further including a rotor for the rotatable region, the rotor extending in the direction of the axis, the rotor and the first and second segments being on opposite sides of the anode.

43. The tube of claim 38 further including a rotor for the rotatable region, the rotor extending in the direction of and surrounding the axis, the first and second segments being on the same side of the anode and arranged so the first and second segments extend through the rotor.

44. The tube of claim 37 further including a rotor for the rotatable region, the rotor extending in the direction of the axis, the rotor and the first and second segments being on opposite sides of the anode.

45. The tube of claim 37 further including a rotor for the rotatable region, the rotor extending in the direction of and surrounding the axis, the first and second segments being on the same side of the anode and arranged so the first and second segments extend through the rotor.

46. The tube of claim 4 wherein the anode is constructed so the flow path includes a portion having a wall extending outwardly from a region of the vacuum chamber where the anode is located, the heat exchanger providing heat exchange with said flow path portion.

47. The tube of claim 46 wherein said segment extends in the direction of the axis and in the vicinity of the axis.

48. The tube of claim 47 wherein the flow path includes a structure for providing first and second flow path regions coaxial with and extending in the direction of said axis so the second region surrounds the first region, the first and second regions being such that the flow is in opposite directions in said first and second regions, the heat exchanger providing heat exchange with one of said regions.

49. The tube of claim 4 wherein the heat exchanger is between interior opposed surfaces of the anode.

50. The tube of claim 49 wherein the heat exchanger is arranged to cool the liquid metal in response to cooling fluid supplied to the heat exchanger from a source outside of the chamber.

51. The tube of claim 50 wherein the heat exchanger is coaxial with said axis.

52. The tube of claim 51 wherein each of the anode, the flow path and the heat exchanger has a segment with a substantial length in the direction of the axis, said segment of the anode surrounding said segment of the flow path and said segment of the heat exchanger.

53. The tube of claim 52 wherein the heat exchanger includes a solid mass having internal flow paths extending generally radially of the axis for the fluid, the generally radially extending flow paths extending for a substantial distance in the direction of the axis.

54. The tube of claim 3 wherein the path includes first and second segments extending in the direction of the axis, the first and second segments being in the vicinity of the axis, the first portion having an inlet from the first segment, the second portion having an outlet into the second segment.

55. The tube of claim 54 wherein the first segment is along the axis and the second segment is coaxial with and surrounds the first segment.

56. The tube of claim 55 wherein the anode is constructed so facing radially extending walls of the flow path through the anode are rotatable together about the axis with the anode region.

57. The tube of claim 54 wherein the first portion inlet has a smaller radius than the second portion outlet to assist in providing centrifugal pumping of the liquid.

58. The tube of claim 3 wherein the flow path through the anode includes first and second facing radially extending wall portions, the first wall portion being rotatable with the anode region, the second wall portion being stationary.

59. The tube of claim 58 wherein at least one of the facing radially extending wall portions includes pumping fins for the liquid.

60. The tube of claim 3 wherein the flow path in the vicinity of the track has a smaller cross-sectional area than other parts of the flow path to increase the liquid flow rate.

61. The tube of claim 3 wherein one of said portions includes several radially extending slots coaxial with said axis.

62. The tube of claim 3 wherein a wall surface of the heat exchanger that is stationary with respect to the track and a wall surface rotatable with the track are arranged in facing relation so a gap exists between them and there is a tendency for the liquid metal to pass outside of the gap, a structure in the gap for substantially preventing passage of the liquid metal through the gap.

63. The tube of claim 62 wherein the structure includes a labyrinth having surfaces that are not wettable by the liquid metal.

64. The tube of claim 1 wherein the heat exchanger includes a stationary solid high thermal conductivity material in thermal heat conduction relation with the liquid metal and responsive to a flowing cooling fluid, the solid material including passages for the flowing cooling fluid, solid heat exchange material in thermal conduction contact with the liquid metal.

65. The tube of claim 1 wherein the anode includes a mass of graphite.

66. The tube of claim 65 wherein the mass carries the track and includes a central bore having an axis coincident with the track rotation axis, the mass including first and second sets of several internal conduits for a recirculating liquid metal, first and second sets having ends on a wall of the bore, and intersecting within the mass, without extending to exterior surfaces of the mass, the ends of the conduits of the first of said sets being proximate one end of the bore and passing in proximity with said track, the ends of the conduits of the second of said sets being proximate an end of the bore opposite said one end.

67. The tube of claim 1 wherein a wall surface of the heat exchanger that is stationary with respect to the track and a wall surface rotatable with the track are arranged in facing relation so a gap exists between them and there is a tendency for the liquid metal to pass outside of the gap, a structure in the gap for substantially preventing passage of the liquid metal through the gap.

68. The tube of claim 67 wherein the structure includes a labyrinth having surfaces that are not wettable by the liquid metal.

69. The tube of claim 1 wherein the liquid metal is in a gap between a surface of a portion of the anode that rotates with the track and a facing stationary surface, the track being displaced from an axis about which the track rotates; the gap being (1) between a portion of the anode rotatable with the track, (2) close to the axis relative to the track and (3) elongated in the direction of the axis.

70. The tube of claim 1 wherein the heat exchanger is located between opposite ends of the anode, and means for supplying a cooling fluid to the heat exchanger.

71. A vacuum tube comprising a vacuum chamber including a cathode, an anode having a rotatable track responsive to electrons derived from the cathode, and means for cooling said anode, said cooling means including:

a) a confined liquid including a metal, the liquid having sufficiently low vapor pressure at the anode operating temperature and chamber pressure so the liquid does not vaporize while the tube is operating, and b) a heat exchanger including a stationary solid material having a high thermal conductivity surface in thermal heat conduction relation with the liquid, the liquid being confined in a recirculating path traversing the inner periphery of said anode, said recirculating path defined by a gap between a surface portion of the rotatable anode and the surface of the heat exchanger and a labyrinth at each end of the gap, each labyrinth including an external surface of material that is not wettable by the liquid metal.

72. The tube of claim 71 wherein the liquid includes a ferrofluid and the confining structure comprises magnet means for confining the ferrofluid including liquid.

73. The tube of claim 71 wherein the anode includes a mass of pyrolytic graphite.

74. The tube of claim 73 wherein the mass of pyrolytic graphite is arranged as multiple abutting structures having high thermal conductivity crystalline axes extending generally radially of the track rotation axis between the region and the heat exchanger and low thermal conductivity crystalline axes extending generally axially of the track rotation axis.

75. The tube of claim 74 wherein the structures are plates.

76. The tube of claim 74 wherein the structures are nested cones.

77. The tube of claim 71 wherein the solid material comprises a porous metal mass, the flow path comprising pores of the mass.

78. The tube of claim 77 wherein the porous metal mass comprises bonded metal particles.

79. The tube of claim 78 wherein the porous metal mass comprises a bundle of metal wires extending in generally the same direction as the fluid flow and having spaces between them through which the fluid can flow.

80. The tube of claim 77 wherein the wires have a circular cross-section each of the same diameter and bonded adjacent regions between which the spaces are located.

81. The tube of claim 77 wherein the wires have a hexagonal cross-section each of the same area and shape and bonded adjacent regions between which the spaces are located.

82. The tube of claim 71 wherein the heat exchanger comprises plural stacked plate like structures having faces generally in the fluid flow direction through the heat exchanger, the plate like structures including numerous axial passages having a small area relative to the area of the plate faces, the fluid flowing axially through the numerous passages.

83. The tube of claim 82 wherein the plate like structures are made so the thermal conductivities thereof in directions normal to and aligned with the fluid flow through the passages are high and low respectively.

84. The tube of claim 82 wherein the plate like structures are metal discs spaced from each other in the flow direction of the fluid in the heat exchanger.

85. A vacuum tube comprising a vacuum chamber including a cathode, an anode having a rotatable track responsive to electrons derived from the cathode, and a means for cooling said track, said cooling means including: a liquid metal having sufficiently low vapor pressure at the anode operating temperature and chamber pressure so the liquid does not vaporize while the tube is operating, a portion of the anode including the track being rotatable about an axis, the track being displaced from the axis;

a closed recirculating flow path for the liquid metal to direct flow internally through the anode past the track, the flow path including first and second portions that extend radially of the axis and a third portion extending longitudinally of the axis in proximity to the axis so the liquid metal is self pumped from the third portion into the first portion and from the second portion into the third portion in response to heat applied thereto by the track and centrifugal force applied thereto by rotation, the liquid metal flowing into the second portion after passing the track and flowing into the first portion before passing the track.

86. The tube of claim 85 wherein the track is displaced from a common rotation axis for the anode and the track by approximately the maximum displacement of the flow path from the axis.

87. The tube of claim 86 wherein the flow path has a larger cross-sectional area at greater distances from the axis.

88. The tube of claim 87 wherein the geometry is such that the liquid metal is at least partially mechanically pumped.

89. The tube of claim 87 wherein the geometry is such that the liquid metal is at least partially pumped by a temperature differential along a flow path for the liquid.

90. The tube of claim 87 wherein the geometry is such that passages in different portions of the flow path have different cross-sectional areas.

91. The tube of claim 90 wherein passages in the flow path that extend radially of the axis about which the anode rotates and through which the liquid metal flows are such that passages have a greater cross-sectional area at greater radial distances of the anode.

92. The tube of claim 90 wherein the geometry is such that the cross-sectional area of the flow path is decreased in the region near the anode track.

93. A vacuum tube comprising a vacuum chamber including:

a cathode, an anode having a rotatable track responsive to electrons derived from the cathode, said anode further comprising a mass of graphite which carries the track and includes a central bore having an axis coincident with a rotation axis of said track, and means for cooling said anode track, said cooling means including:

a) a liquid including a metal in a closed circulation path, the liquid having sufficiently low vapor pressure at the anode operating temperature and chamber pressure so the liquid does not vaporize while the tube is operating, and b) a heat exchanger comprising a mass of solid material arranged so a cooling fluid flows through the solid mass of material substantially axially of the track rotation axis and heat from the track flows radially inward through the mass to the fluid in a heat conduction path with the liquid for cooling the liquid the mass including first and second sets of several internal conduits for said recirculating liquid metal, the first and second sets having ends on a wall of the bore and intersecting within the mass without extending to exterior surfaces of the mass, the ends of the conduits of the first of said sets being proximate to one end of the bore and passing in proximity with said track, the ends of the conduits of the second of said sets being proximate an end of the bore opposite of said one end.

94. The tube of claim 93 wherein the heat exchanger and a rotation axis for the track have substantially coincident axes and the heat conduction path is radial inward from the track to the heat exchanger.

95. The tube of claim 94 wherein the means for supplying the cooling fluid causes the cooling fluid to flow axially through a first opening at a first end of the tube, through the heat exchanger, and to and through an opening at a second end of the tube opposite from the first end of the tube.

96. The tube of claim 94 wherein the means for supplying the cooling fluid causes the cooling fluid to flow axially through a first opening at a first end of the tube, through the heat exchanger, and to a chamber downstream of the heat exchanger where the cooling fluid flow direction is reversed.

97. The tube of claim 94 wherein the means for supplying the cooling fluid causes the cooling fluid to flow axially through a first opening at a first end of the tube, and to a chamber downstream of the heat exchanger where the cooling fluid flow direction is reversed, and through the heat exchanger to and through a second opening at the first end of the tube.

98. The tube of claim 93 wherein the heat conduction path includes a film of the liquid between the heat exchanger and rotating anode portion.

99. The tube of claim 98 further including means for confining the liquid film to a gap between the heat exchanger and rotating anode portion.

100. The tube of claim 99 wherein the liquid includes a liquid metal and the confining means includes a labyrinth having surfaces that are not wettable by the liquid metal.

101. The tube of claim 93 wherein the anode includes a mass of pyrolytic graphite.

102. The tube of claim 101 wherein the mass of pyrolytic graphite is arranged as multiple abutting structures having high thermal conductivity crystalline axes extending generally radially of the track rotation axis between the region and the heat exchanger and low thermal conductivity crystalline axes extending generally axially of the track rotation axis.

103. The tube of claim 102 wherein the structures are plates.

104. The tube of claim 102 wherein the structures are nested cones.

105. The tube of claim 93 wherein the liquid contacts a metal exterior side wall of the heat exchanger.

106. The tube of claim 105 wherein the metal side wall includes an indented region between end walls of the heat exchanger, the indented region being a reservoir for liquid.

107. The tube of claim 106 wherein the liquid contacting the side walls is a film in a gap between the side wall and a rotating wall of the anode.

108. The tube of claim 94 wherein the mass of solid material includes a porous metal mass.

109. The tube of claim 108 wherein the porous metal mass comprises numerous metal spheres of the same diameter having bonded adjacent regions.

110. The tube of claim 108 wherein the porous metal mass comprises numerous metal rods having circular cross-sections of the same diameter having bonded adjacent regions, the rods having longitudinal axes in the direction of the rotation axis.

111. The tube of claim 108 wherein the porous metal mass comprises numerous metal rods having regular hexagonal cross-sections of the same area having bonded adjacent regions.

112. A vacuum tube comprising a vacuum chamber including:

a cathode, an anode structure having a rotatable track responsive to electrons derived from the cathode, and means for cooling said rotatable track, said cooling means including:

a liquid metal having a relatively high thermal conductivity and sufficiently low vapor pressure at the anode structure operating temperature and chamber pressure so the liquid does not vaporize while the tube is operating, the liquid being in a closed recirculating path positioned and arranged so it can fill in the gap between a rotatable circumferential surface of the anode structure and a stationary circumferential surface, and means for confining the liquid to a region between said surfaces while the track is rotating and stationary.

113. The vacuum tube of claim 112 further including a reservoir for the liquid, the liquid and reservoir being positioned and arranged so that when the anode rotates the liquid moves radially into the gap by centrifugal force from the reservoir to provide a high thermal conductivity path between the surfaces.

114. The vacuum tube of claim 112 wherein the means for confining includes a wick located on the rotatable surface, the liquid being stored in the wick while the rotatable surface is stationary and moving radially across the gap to provide a high thermal conductivity path between the surfaces while the rotatable surface is rotating.

115. The vacuum tube of claim 114 wherein the wick is on an outwardly facing cylindrical surface of the anode structure.

116. The vacuum tube of claim 114 wherein the wick is on an inwardly facing cylindrical surface of the anode structure.

117. The vacuum tube of claim 114 wherein a first portion of the wick is on an inwardly facing cylindrical surface of the anode structure and a second portion of the wick extends radially inward of the anode structure.

118. The vacuum tube of claim 114 wherein the means for confining includes a pair of radially extending walls between which the wick is located.

119. The vacuum tube of claim 118 wherein the walls extend radially inwardly from the stationary surface and the wick is on an outwardly facing cylindrical surface of the anode.

120. The vacuum tube of claim 118 wherein the walls extend radially inward from the anode structure and the wick is on an inwardly facing cylindrical surface of the structure structure.

121. The vacuum tube of claim 112 wherein the stationary circumferential surface is on a solid heat exchanger including a structure through which a heat exchange fluid flows.

122. The vacuum tube of claim 112 wherein the means for confining includes a pair of spaced walls extending radially from one of said surfaces, the liquid being located between said walls.

123. The vacuum tube of claim 122 wherein facing surfaces of the walls between which the liquid is located are non-wettable by the liquid.

124. The vacuum tube of claim 112 wherein the liquid comprises a ferrofluid and the means for confining includes spaced magnetic pole faces between which the ferrofluid is located.

* * * * *